US005958306A

United States Patent [19]

Curtis

[11] Patent Number: 5,958,306

[45] Date of Patent: Sep. 28, 1999

[54] PRE-COLLECTORS FOR COOLING TOWERS

[76] Inventor: Harold D. Curtis, 12312 Swan Haven Dr., Oklahoma City, Okla. 73170

[21] Appl. No.: 08/951,802

[22] Filed: Oct. 16, 1997

[51] Int. Cl.[6] ..... B01F 3/04

[52] U.S. Cl. ..... 261/30; 261/112.2; 261/DIG. 11; 261/DIG. 85

[58] Field of Search ..... 261/30, 112.1, 261/112.2, DIG. 11, DIG. 85

[56] References Cited

U.S. PATENT DOCUMENTS

| | | | |
|---|---|---|---|
| 965,116 | 7/1910 | Morison . | |
| 1,002,578 | 9/1911 | Gayley . | |
| 1,074,913 | 10/1913 | Walter . | |
| 1,102,813 | 7/1914 | Stocker . | |
| 1,287,402 | 12/1918 | Nordberg . | |
| 1,343,832 | 6/1920 | Kuypers . | |
| 1,383,039 | 6/1921 | Uhde . | |
| 1,549,068 | 8/1925 | Dickey . | |
| 1,647,281 | 11/1927 | Doyle . | |
| 2,231,088 | 2/1941 | Richardson | 261/112 |
| 2,250,978 | 7/1941 | Weiland et al. | 62/140 |
| 2,299,920 | 10/1942 | Moore | 261/30 |
| 2,311,155 | 2/1943 | Carr | 261/30 |
| 2,437,484 | 3/1948 | Simons | 261/109 |
| 2,445,908 | 7/1948 | DeFlon et al. | 261/23 |
| 2,606,750 | 8/1952 | Jacir | 261/30 |
| 2,636,371 | 4/1953 | Stephens | 62/168 |
| 2,775,310 | 12/1956 | Shelton . | |

(List continued on next page.)

FOREIGN PATENT DOCUMENTS

| | | | |
|---|---|---|---|
| 511792 | 1/1921 | France . | |
| 720676 | 2/1932 | France . | |
| 876525 | 11/1942 | France . | |
| 1158377 | 6/1958 | France . | |
| 389867 | 2/1924 | Germany . | |
| 1451155 | 2/1969 | Germany . | |
| 2 250 776 | 4/1974 | Germany . | |
| 25 22 155 | 1/1976 | Germany . | |
| 25 47 719 | 4/1977 | Germany . | |
| 3501278 | 7/1985 | Germany . | |
| 52-26645 | 2/1977 | Japan . | |
| 54-152245 | 11/1979 | Japan . | |
| 57-142483 | 9/1982 | Japan . | |
| 63-210594 | 8/1988 | Japan . | |
| 15386 | 9/1905 | Norway . | |
| 929985 | 5/1982 | U.S.S.R. . | |
| 1502944 | 8/1989 | U.S.S.R. . | |
| 1511562 | 9/1989 | U.S.S.R. . | |
| 711303 | 6/1954 | United Kingdom . | |
| 1047454 | 11/1966 | United Kingdom | 261/DIG. 85 |
| 1419623 | 12/1975 | United Kingdom . | |

OTHER PUBLICATIONS

Exhibit A—Untitled drawing (undated but admitted to be prior art).

Cooling Towers, "Power" Mar. 1973, pp. 5–9 to 5–11.

Paper entitled "Drainage Collection System Shape of the Things to Come?" by Marcel R. Lefevre (1987).

*Power Engineering*, Jul., 1987, article entitled "Technology, education, upgrading boost cooling tower performance" by R. C. Rittenhouse.

*Power Engineering*, Mar., 1988, article entitled "'New' drainage system upgrades cooling towers" by Marcel R. Lefevre.

*Primary Examiner*—C. Scott Bushey

*Attorney, Agent, or Firm*—McAfee & Taft

[57] ABSTRACT

A collection system for use in cooling towers is disclosed. The collection system includes a plurality of spaced collection troughs with a pre-collector thereabove disposed between the fill material in the cooling tower and the collection troughs. The pre-collector includes a plurality of corrugated sheets positioned laterally and transversely adjacent one another to substantially fill the space between the collection troughs and the fill material. Water falling through the cooling tower will fall on the corrugations and will be directed by the corrugations into vertical discharge drains defined by the corrugated sheets. The vertical discharge drains will direct liquid falling onto the sloped flow surfaces defined by the corrugated sheets into collection troughs therebelow.

26 Claims, 16 Drawing Sheets

U.S. PATENT DOCUMENTS

| | | | |
|---|---|---|---|
| 2,780,306 | 2/1957 | Boyle et al. . | |
| 2,833,122 | 5/1958 | Kohl et al. | 62/2 |
| 2,890,870 | 6/1959 | Spiselman | 261/30 |
| 2,915,302 | 12/1959 | Jacir | 261/30 |
| 3,168,596 | 2/1965 | Jamison | 261/29 |
| 3,214,348 | 10/1965 | Lichtenstein | 202/47 |
| 3,226,894 | 1/1966 | Burchardt et al. | 52/223 |
| 3,253,819 | 5/1966 | Talbot | 261/25 |
| 3,259,177 | 7/1966 | Niemann | 165/34 |
| 3,262,682 | 7/1966 | Bredberg | 261/29 |
| 3,290,867 | 12/1966 | Jacir . | |
| 3,363,885 | 1/1968 | Meek | 261/30 |
| 3,384,165 | 5/1968 | Mathews | 165/122 |
| 3,608,873 | 9/1971 | Furlong | 261/30 |
| 3,739,556 | 6/1973 | Waters . | |
| 3,878,273 | 4/1975 | Anderson | 261/151 |
| 3,917,765 | 11/1975 | Furlong et al. | 261/111 |
| 3,969,447 | 7/1976 | Glitsch et al. | 261/111 |
| 4,044,078 | 8/1977 | Curtis et al. | 261/30 |
| 4,094,937 | 6/1978 | Bodick et al. | 261/111 |
| 4,157,368 | 6/1979 | Fernandes | 261/155 |
| 4,215,080 | 7/1980 | Ribier et al. | 261/111 |
| 4,218,408 | 8/1980 | Henning et al. | 261/112.2 |
| 4,242,850 | 1/1981 | Merenyi et al. | 52/745 |
| 4,267,130 | 5/1981 | Curtis | 261/112 |
| 4,301,097 | 11/1981 | Curtis | 261/109 |
| 4,385,010 | 5/1983 | Bosne | 261/110 |
| 4,416,835 | 11/1983 | Bosne | 261/DIG. 85 |
| 4,416,836 | 11/1983 | Sinek | 261/112 |
| 4,422,983 | 12/1983 | Bardo et al. | 261/24 |
| 4,459,244 | 7/1984 | Norback | 261/112.2 |
| 4,521,350 | 6/1985 | Lefevre | 261/DIG. 85 |
| 4,622,183 | 11/1986 | Sonnenschein et al. | 261/110 |
| 4,637,903 | 1/1987 | Bardo et al. | 261/24 |
| 4,769,186 | 9/1988 | Raybon | 261/109 |
| 4,788,013 | 11/1988 | Kinney, Jr. et al. | 261/24 |
| 4,913,710 | 4/1990 | Reverdv . | |
| 5,028,357 | 7/1991 | Bardo | 261/111 |
| 5,143,657 | 9/1992 | Curtis | 261/89 |
| 5,152,458 | 10/1992 | Curtis | 239/222.17 |
| 5,227,095 | 7/1993 | Curtis | 261/30 |
| 5,236,625 | 8/1993 | Bardo et al. | 261/24 |
| 5,464,573 | 11/1995 | Tokerud et al. | 261/DIG. 85 |
| 5,487,531 | 1/1996 | Curtis | 261/30 |
| 5,487,849 | 1/1996 | Curtis | 261/30 |
| 5,545,356 | 8/1996 | Curtis | 261/30 |

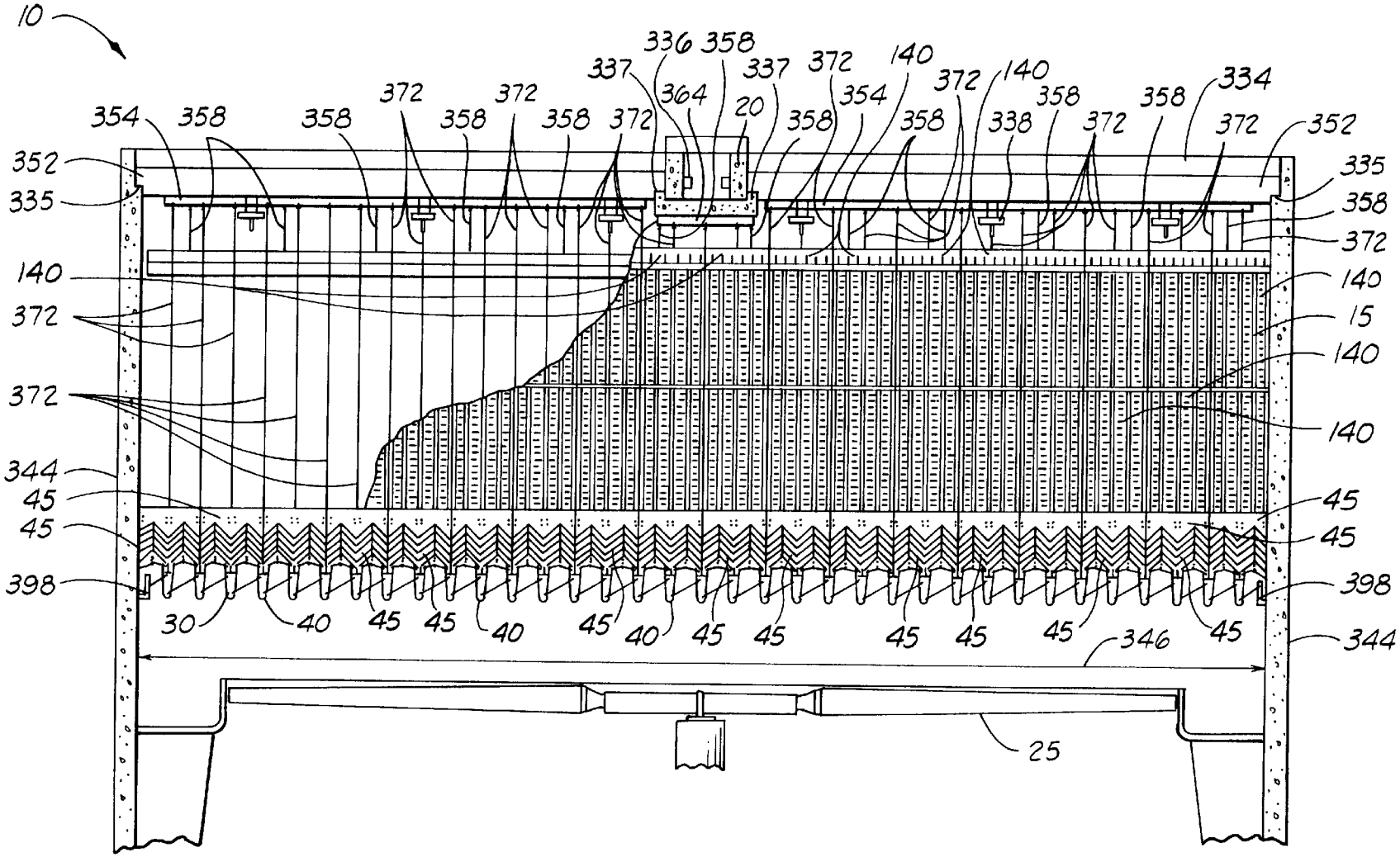
10
352
335
140
372
372
344
45
45
398
354
358
372
358
372
358
372

PRE-COLLECTORS FOR COOLING TOWERS

BACKGROUND OF THE INVENTION

The present invention relates generally to cooling towers and more particularly but not by way of limitation to a cooling tower with a collection system that includes a pre-collector for directing water into a plurality of collection troughs.

A counterflow cooling tower, which is one common type of industrial cooling tower known in the art, is one wherein water falls downward through a fill material while cooling air moves upward through the fill material. The term "counterflow" refers to the fact that the water and air are moving in opposite directions. Counterflow cooling towers traditionally may be of three types, namely, induced draft, natural draft, and forced draft.

An induced draft counterflow cooling tower has a fan located on top of the tower which sucks air up through the fill material. Examples of such towers are seen in U.S. Pat. Nos. 4,267,130 and 4,301,097, both to Curtis.

Natural draft cooling towers do not utilize fans to assist air flow but rely on the natural tendency of warm air to flow upward. A natural draft counterflow cooling tower is shown at FIG. 1 of U.S. Pat. No. 4,521,350 to LeFevre. The LeFevre patent shows the use of a drainage collection system below the fill material in the natural draft counterflow cooling tower shown therein.

Forced draft counterflow cooling towers, examples of which are shown in U.S. Pat. Nos. 2,606,750 and 2,915,302 to Jacir, traditionally have a fan located on the side of the tower which blows air into a plenum chamber on a lower side of the tower. Vanes are used to turn the air 90° to direct it upward through the tower. The term "forced draft" is understood to refer to a system like that of Jacir having a fan on the side of the tower blowing into a lower plenum so the air must then turn 90° to flow upward through the tower.

Other forced draft cooling towers, referred to herein as direct forced draft counterflow cooling towers, have a fan located below the fill material for forcing air directly upward therethrough. Examples of direct forced draft counterflow cooling towers are shown in U.S. Pat. No. 5,227,095 to Curtis issued Jul. 13, 1993, U.S. Pat. No. 5,487,531 to Curtis, issued Jan. 30, 1996, and U.S. Pat. No. 5,545,356 to Curtis, issued Aug. 13, 1996, the details of all three of which are incorporated herein by reference.

The prior art includes many versions of drainage collection systems used in cooling towers for collecting the liquid falling through the tower. Several of the prior art collection systems are made up of a series of overlapping sloped collection plates with troughs along their lower edge. One such system is shown, for example, in the LeFevre U.S. Pat. No. 4,521,350 patent cited above. Other such systems are shown in U.S. Pat. No. 5,227,095 to Curtis. A dual layered drainage collection system, which includes an upper layer of parallel elongated collection plates and a lower layer of parallel elongated collection plates, is shown in U.S. Pat. No. 5,487,531. Although the collection systems shown in the aforementioned patents perform adequately, there is a continuing need for collection systems that will collect substantially all of the water falling in a cooling tower, especially in direct forced draft counterflow cooling towers to prevent the water from reaching the fan, to eliminate or at least lessen icing problems in cold weather climates, and at the same time to decrease the pressure drop which is created when the air flowing upward through the cooling tower is interrupted by and forced to flow around the various components in the interior of the cooling tower, such as the collection system.

SUMMARY OF THE INVENTION

The present invention provides an improvement in counterflow cooling towers and more specifically provides an improvement in collection systems used in direct forced draft counterflow cooling towers.

The drainage collection system of the present invention includes a pre-collector which directs liquid falling through the cooling tower into a plurality of spaced collection troughs. As explained in more detail herein, the pre-collector directs substantially all of the liquid falling through the cooling tower into the collection troughs and is thus especially suited for use with direct forced draft counterflow cooling towers since little or no liquid will be allowed to reach the fans located below the collection troughs. In addition, the spaced collection troughs which receive liquid from the pre-collectors are warmed by the water received therein which aids in the prevention of icing during cold weather. The pre-collectors themselves are designed such that difficulties due to icing are minimized. Further, the spacing of the collection troughs is such that the system causes less pressure drop than other collection systems having the capability of collecting substantially all of the liquid falling through a cooling tower.

The cooling tower preferably includes a body of fill material, a liquid distribution system located above the body of fill material and may include a drift eliminator located above the liquid distribution system. The cooling tower further includes a fan for directing cooling air upward through the body of fill material. Preferably, the cooling tower is a direct forced draft counterflow cooling tower which has a fan located beneath the fill material. The collection system of the present invention is located below the fill material, and, in a direct forced draft counterflow cooling tower is thus located between the fill material and the fan disposed therebelow.

The collection system of the present invention includes a plurality of elongated collection troughs for receiving the liquid gravitating downward through the cooling tower. A pre-collector is disposed between the fill material and the collection troughs for directing the liquid into the collection troughs. The pre-collector preferably comprises a plurality of corrugated sheets, or panels referred to herein as pre-collector or pre-collection sheets, or pre-collector or pre-collection panels, wherein the corrugations in the sheets direct the liquid into the collection troughs. Preferably, the corrugations in the pre-collection sheets define a plurality of parallel sloped flow surfaces which direct the liquid to a plurality of substantially vertical flow paths, which may be referred to as vertical discharge drains, defined by the pre-collection panels. The collection troughs are positioned below the vertical flow paths to collect the liquid therefrom.

Numerous objects, features and advantages of the present invention will be readily apparent to those skilled in the art upon a reading of the following disclosure when taken in conjunction with the following drawings.

BRIEF DESCRIPTION OF THE DRAWINGS

FIG. 6 shows a view of one sheet of fill media taken from line 6—6 of FIG. 4.

FIG. 9 shows a side view of a plurality of sheets of fill media and pre-collector panels connected thereto.

FIG. 11 schematically shows a view looking at the internal components of a cooling tower utilizing a pre-collector of the present invention.

FIG. 13 schematically shows a top view of the cooling tower showing the support structure for the fill material and collection system of the present invention.

FIG. 23 shows a section from line 23—23 of FIG. 22.

FIG. 25 is a side view of a flapper means of the present invention.

DETAILED DESCRIPTION OF A PREFERRED EMBODIMENT

Figure 12:
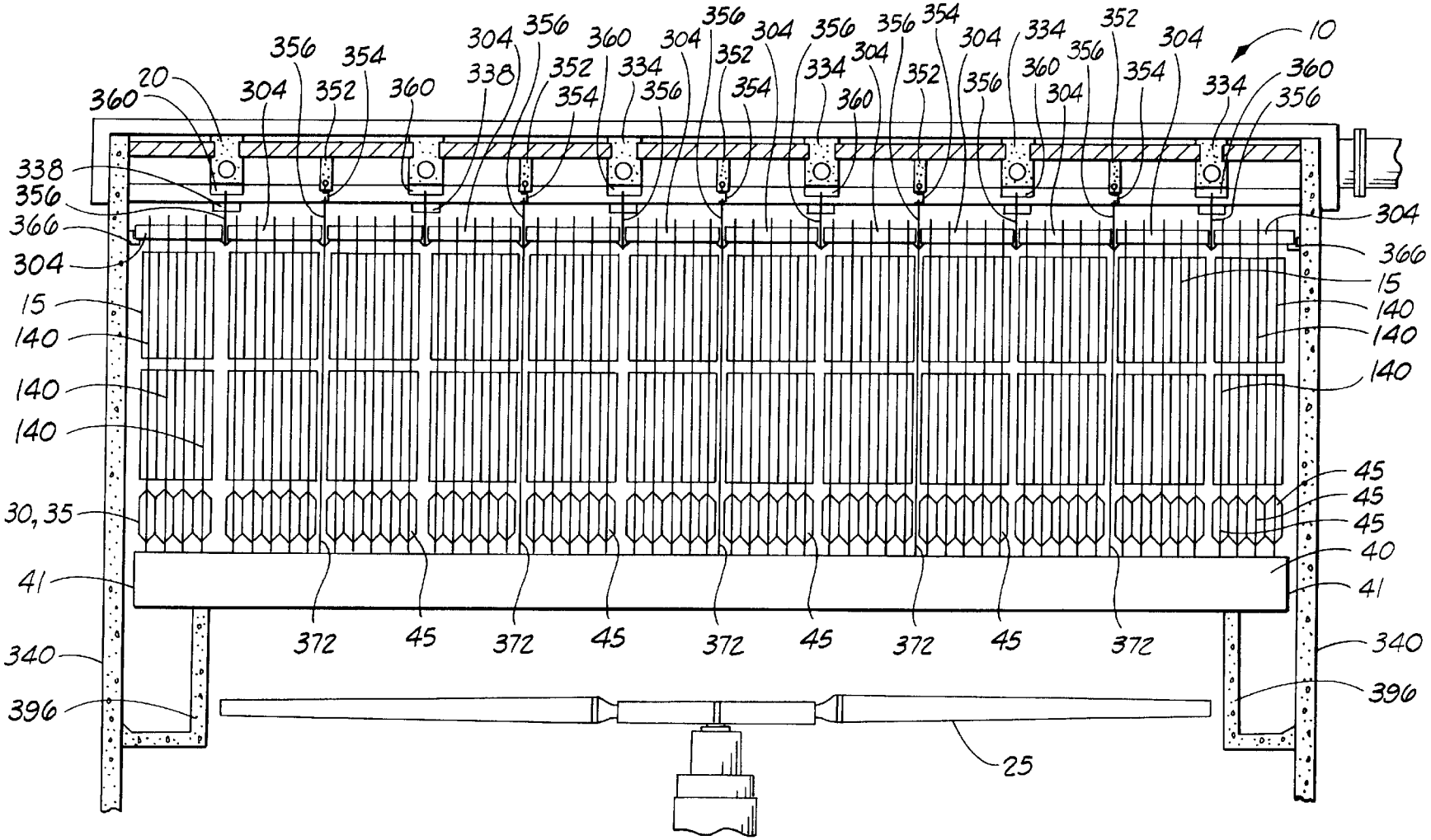
FIG. 12 schematically shows a view looking at the internal components of a cooling tower utilizing the collection system of the present invention. The view in FIG. 12 is taken 90° from the view in FIG. 11.
Figure 18:
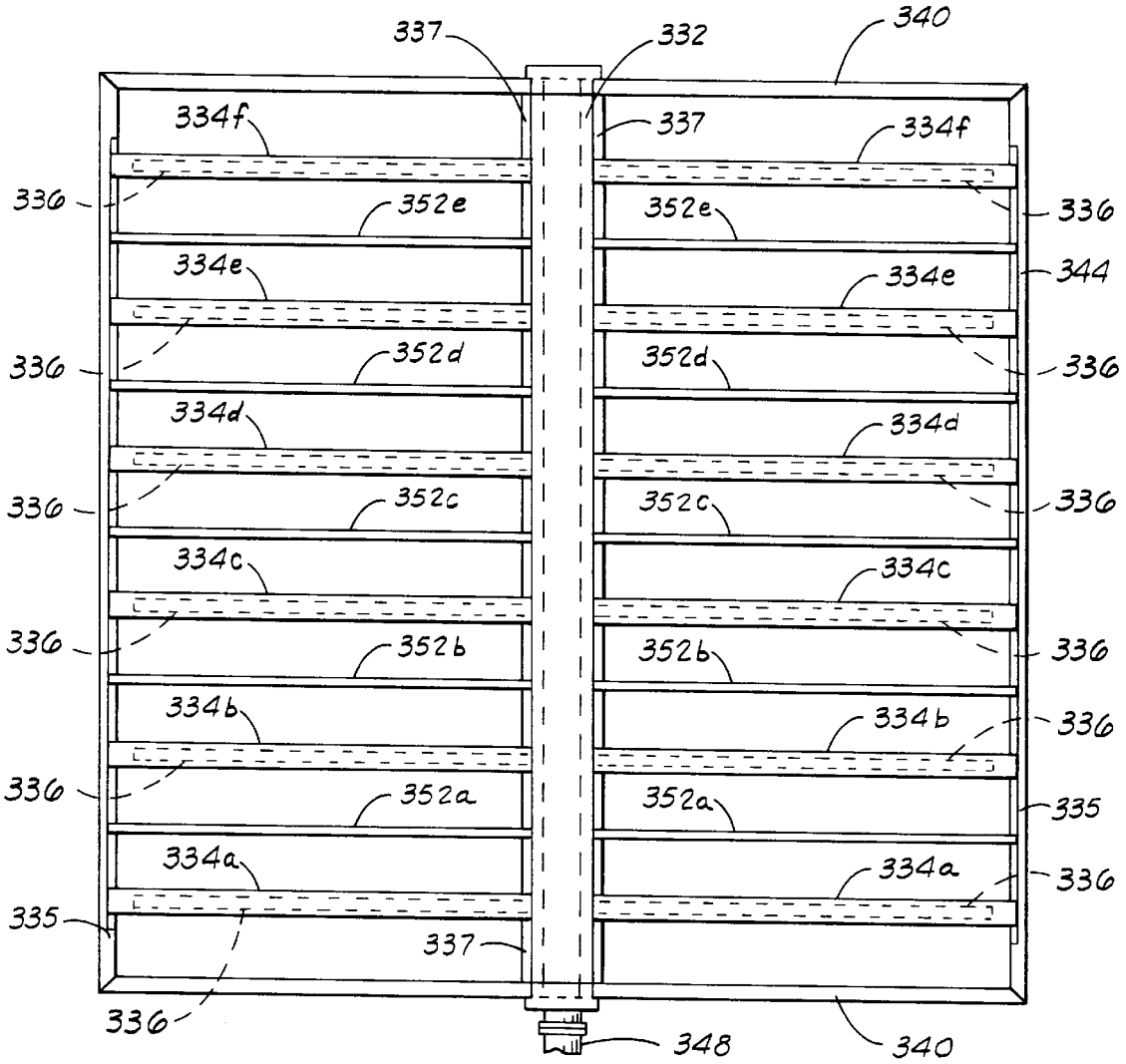
FIG. 18A, 18B and 18C show the top, side and front views, respectively, of a wire hanger insert of the present invention.

Referring now to the drawings and more specifically to FIGS. 11–13, a cooling tower 10 is schematically shown therein. Cooling tower 10 includes a body of fill material 15 and a liquid distribution system 20 located thereabove, so that liquid from the liquid distribution system will gravitate downward through body of fill material 15. The cooling tower schematically shown in FIGS. 11–13 may have a fan 25 located below body of fill material 15 for blowing cooling air upward therethrough to contact the falling liquid, which in a cooling tower is preferably water. A collection system 30 is disposed between fan 25 and fill material 15 to collect the water falling downward through the tower and to prevent the water from reaching fan 25.

The collection system includes a pre-collector 35 having a plurality of elongated collection troughs 40, having outer ends 41, positioned therebelow. Collection system 30 of the present invention will be described with reference to a direct forced draft counterflow cooling tower having concrete sidewalls. However, the collection system, and the fill material described herein, can be used in connection with cooling towers having walls comprised of any material and can be used in connection with any type of counterflow or cross flow cooling tower. For instance, U.S. Pat. No. 5,545,356 to Curtis et al., issued Aug. 13, 1996, U.S. Pat. No. 5,487,531 to Curtis issued Jan. 30, 1996, U.S. Pat. No. 5,487,849 issued Jan. 30, 1996, to Curtis and U.S. Pat. No. 5,227,095 issued Jul. 13, 1993, the details all of which are incorporated herein by reference, show various types of cooling towers utilizing various materials. Collection system 30 of the present invention can be used in connection with any of the cooling towers described therein and with any conventional type of cooling tower. The cooling tower schematically shown in FIGS. 11–14 will be described in more detail hereinbelow.

Pre-collector 35 comprises a plurality of pre-collector or pre-collection panels or sheets 45. The details of pre-collection panels 45 and collection troughs 40 are better seen in FIGS. 1–3. Because pre-collection panels 45 are made of a relatively thin material, details, such as edges, are shown in some views, such as FIG. 2, simply as lines for the purposes of clarity.

The pre-collector panel 45 is a corrugated panel having an upper end 50, a lower end 52, a front or forward side 54 and a back or rear side 56. Corrugated pre-collection panel 45 further includes opposed lateral edges 58 comprising a first lateral edge 60 and a second lateral edge 62 and may be divided into a first, or left-hand portion 63 and a second, or right-hand portion 64 by a center line 65. The edge-to-edge direction is referred to herein as the lateral direction.

Each panel 45 comprises a plurality of corrugations 66 and a substantially flat sheet portion 67. Corrugations 66 may include corrugations 69 on left-side portion 63 and corrugations 71 on right-side portion 64. Corrugations 69 define a plurality of ridges 68 and furrows 70 on the front side 54 of left-side portion 63 of panel 45, and a corresponding plurality of ridges 72 and furrows 74 on the back side 56 of left-side 63 of panel 45. In other words, ridges 68 correspond to furrows 74 and ridges 72 correspond to furrows 70. Ridges 68 and 72 include crowns, or tops 73 and 75, respectively, while furrows 70 and 74 include bottoms 76 and 77, respectively.

Figure 2:
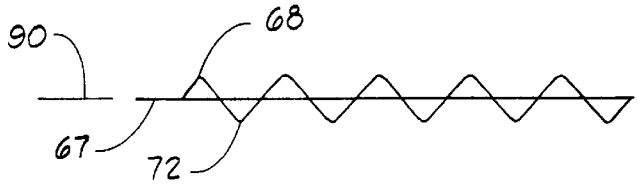
FIG. 2 shows a view from line 2—2 of FIG. 1. The edge of the panel is shown as a line in FIG. 2.
Figure 2A:
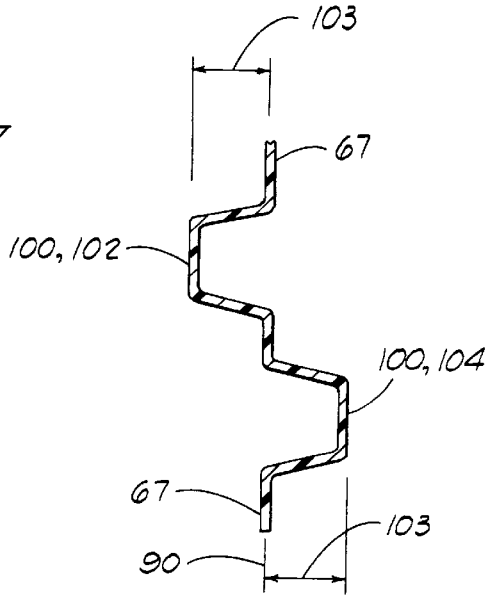
FIG. 2A is a section view taken from line 2A—2A of FIG. 1 and shows the bosses extending from the pre-collector panel of the present invention.
Figure 3A:
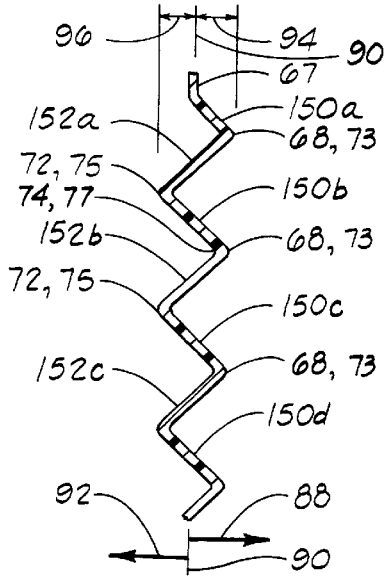
FIGS. 3A and 3B are section views taken from lines 3A—3A and 3B—3B of FIG. 1, respectively.
Figure 2B:
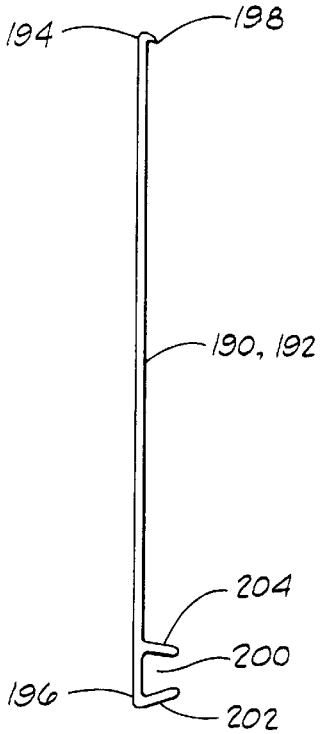
Figure 3B:
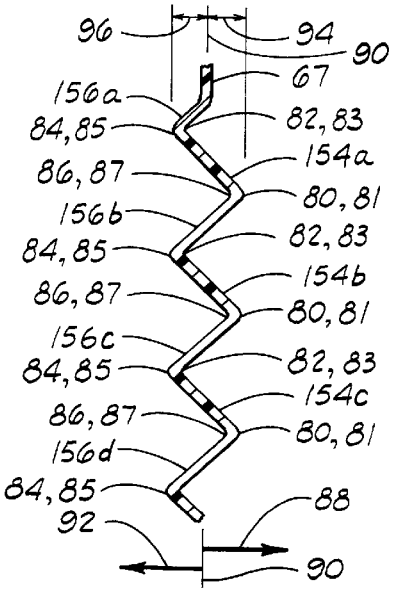
Figure 3:
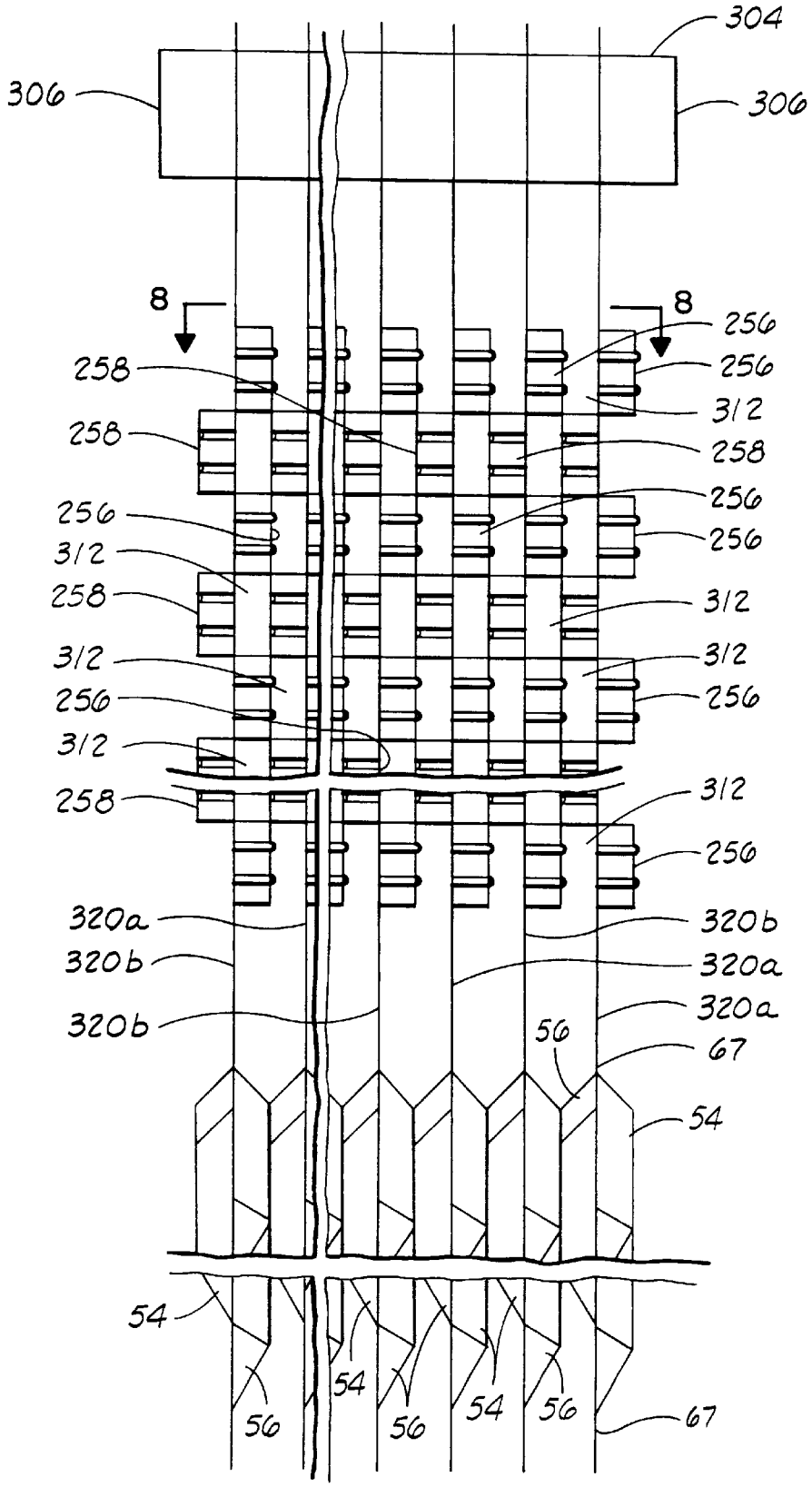

On the front side 54 of right-side portion 64, corrugations 71 define a plurality of ridges 80 having crowns, or tops 81, and furrows 82 having bottoms 83. corresponding ridges 84 having tops, or crowns 85, and furrows 86 having bottoms 87 are defined on the back side 56 of right-side portion 64 of panel 45. Thus, ridges 68 and 80 extend in a forward direction 88 from substantially flat portion 67 while ridges 72 and 84 extend in a rearward direction 92 from flat sheet portion 67. In FIGS. 2, 7 and 9, flat sheet portion 67 is, for purposes of clarity, depicted as a line.

Flat sheet portion 67 defines a planar portion 90, which is preferably a central plane 90 which runs through the center of panel 45 and thus through the thickness of flat sheet portion 67. Thus, in a preferred embodiment, ridges 68 and 80 extend forward the same distance 94 forward from planar portion 90 and ridges 72 and 84 extend the same distance 96 rearward from planar portion 90. More preferably, the distance 94 between planar portion 90 and the crowns 73 and 81 of ridges 68 and 80, respectively, is identical to the distance 96 between planar portion 90 and the crowns 75 and 85 of ridges 72 and 84, respectively. Thus, the corrugations on rear side 56 of left side portion 63, and thus the shape of rear side 56 of left-side portion 63 are substantially identical to the corrugations, and thus the shape of front side 54 of right side portion 64. Likewise, the corrugations on rear side 56 of right-side portion 64 and thus the shape thereof, are substantially identical to the corrugations, and thus the shape, of front side 54 of left-side portion 63.

Figure 1:
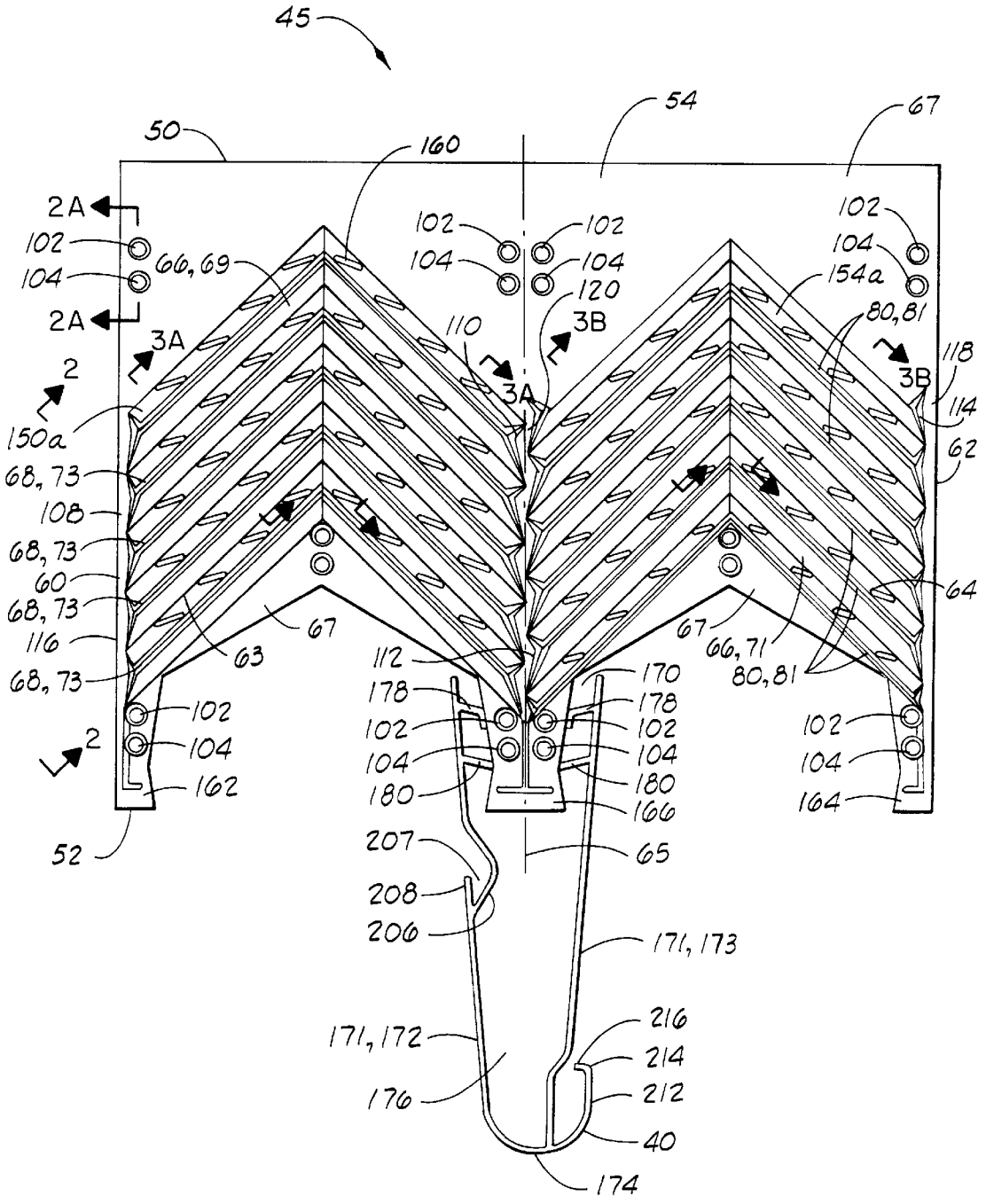
FIG. 1 shows an elevation view of the front side of a pre-collector panel of the present invention.

As viewed in FIG. 1, corrugations 69 on left-side portion 63 and corrugations 71 on right-side portion 64 define a plurality of parallel, generally V-shaped corrugations with alternating ridges and furrows such that, when viewed from the front, the uppermost corrugation on first side portion 63 defines a ridge whereas the uppermost corrugation on second portion 64 defines a furrow.

Each panel further includes a plurality of bosses 100 which includes a plurality 102 extending in forward direction 88 and a plurality of bosses 104 extending in the rear direction 90. Bosses 102 and 104 extend away from central plane 90 a distance 103, which is preferably slightly less than distances 94 and 96 respectively.

Corrugations 69 on first side portion 63 have a first end 108 and second end 110 while corrugations 71 on second portion 64 have a first end 112 and a second end 114. Corrugations 69, and thus ridges 68 and 72 and furrows 74 and 76 taper to flat sheet portion 67 at the first and second ends 108 and 110 thereof, and corrugations 71 taper to flat sheet portion 67 at the first and second ends 112 and 114 thereof. Thus, ridges 68 and 80 taper from crowns 73 and 81, and furrows 70 and 82 taper from bottoms 76 and 83, to the forward surface of flat sheet portion 67. Ridges 72 and 84 taper from crowns 75 and 85, and furrows 74 and 86 taper from bottoms 77 and 87 to the rear surface of flat sheet portion 67.

Panel 45 is substantially flat between first end 108 of corrugations 69 and first lateral edge 60, defining a flat connecting band 116 at first lateral edge 60 thereof. Connecting band 116 comprises part of flat sheet portion 67. Likewise, panel 45 is substantially flat between second end 114 of corrugations 71 and second lateral edge 62, defining a substantially flat connecting band 118 at the second lateral edge 62 thereof. Connecting band 118 comprises a part of flat sheet portion 67.

As viewed in FIG. 1, a vertical flow path, or vertical discharge drain 120 is formed at the center of panel 45 by and between the taper or transition from the second end 110 of corrugations 69 and the taper, or transition from the first end 112 of corrugations 71 to substantially flat sheet portion 67. As is obvious from the drawings, a vertical flow path 120 will likewise be defined on rear side 56 by and between the tapers from the second end of corrugations 69 and the first end of corrugations 71 to the rear surface of flat sheet portion 67.

Corrugations 69 define a plurality of parallel sloped flow surfaces 150 on the forward side 54 of panel 45 and a plurality of sloped parallel flow surfaces 152 on the rear side 56 of panel 45. Likewise, corrugations 71 define a plurality of sloped parallel flow surfaces 154 on the forward side of panel 45 and a plurality of sloped parallel flow surfaces 156 on the rear side 56 thereof. As schematically shown in FIG. 11, a plurality of panels 45 will be positioned laterally adjacent one another so that connecting band 116 at first lateral edge 60 is positioned adjacent to connecting band 118 at second edge 62 of a laterally adjacent panel. This is seen more clearly in FIG. 5, which schematically shows two pre-collection panels 45 positioned laterally adjacent each other. If desired, panels 45 may be mechanically connected at the lateral edges thereof using clips or any other means known in the art.

Figure 5:
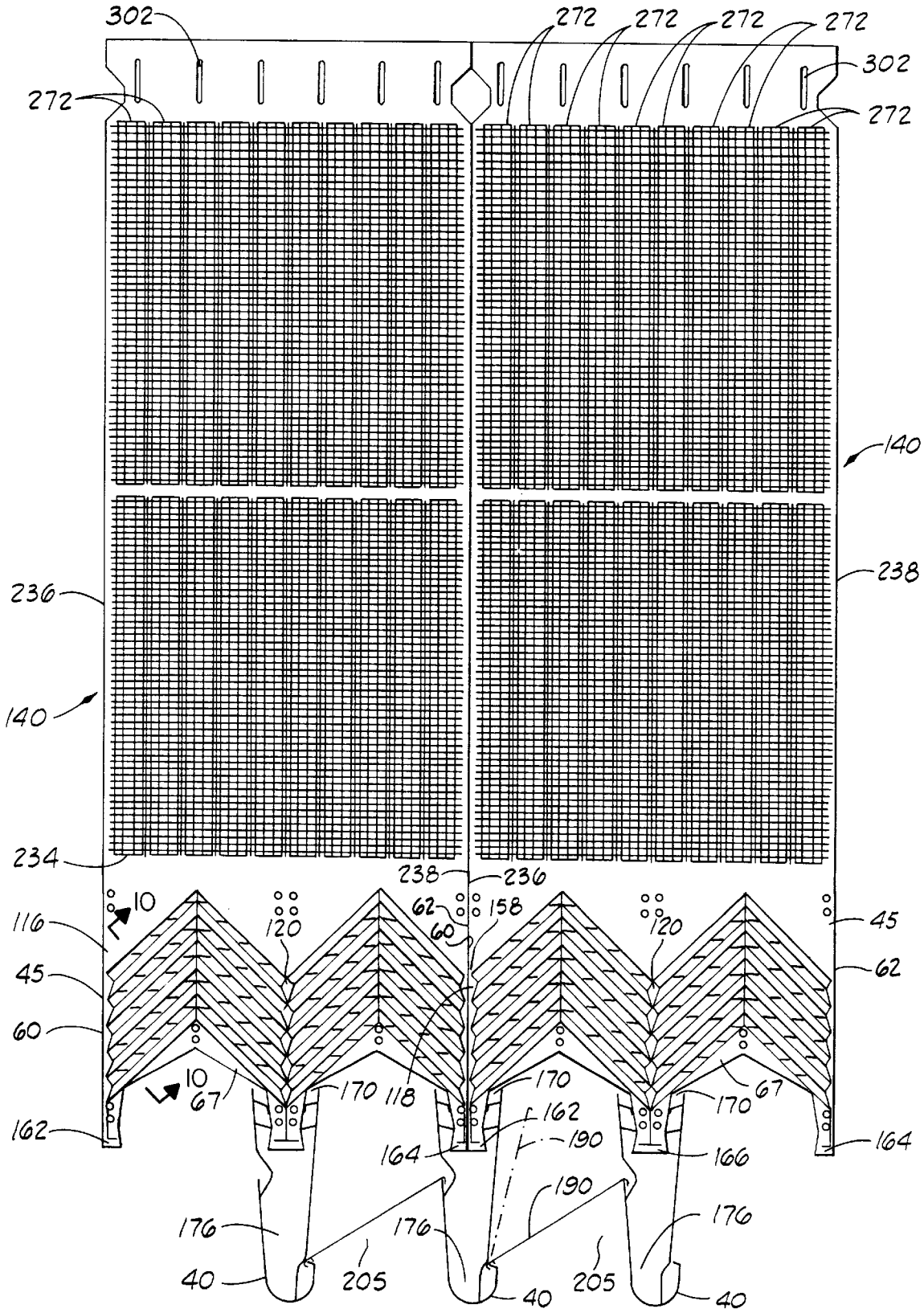
FIG. 5 schematically shows two sheets of fill material and two pre-collection panels connected thereto positioned laterally adjacent each other.

As shown in FIG. 5, a vertical flow path or vertical discharge drain 158 is defined at the edges of laterally adjacent panels. Vertical flow paths 158 are defined by the connecting bands 116 and 118 at the lateral edges of each panel and by the taper or the transition at the first end 108 of corrugations 69 and the second end 114 of corrugations 71. As is apparent from the drawings, vertical flow paths 158 will be defined on both of the front and back sides 54 and 56 of laterally adjacent panels. Vertical flow paths 120 and 158 comprise, and may be referred to collectively as vertical flow paths or vertical discharge drains 159. The schematics in FIG. 5 and FIG. 11, both show pre-collection panels 45 connected to, or integrally formed with a lower end of a sheet of fill material 140 which will be described in more detail hereinbelow.

In operation, water will be distributed downward from the liquid distribution system 20 through the body of fill material 15, which preferably will be comprised of a plurality of sheets or panels 140 of fill material. The water will then fall on the uppermost of flow surfaces 150, 152, 154 and 156, designated with the subscript "a". Because of the inverted V-shape of the corrugations, water will be directed by corrugations 69 and 71 and thus by the sloping flow surfaces 150, 152, 154 and 156 into the substantially vertical flow paths 159 defined at the edges of laterally adjacent panels 45 and at the centers of pre-collection panels 45.

Figure 10:
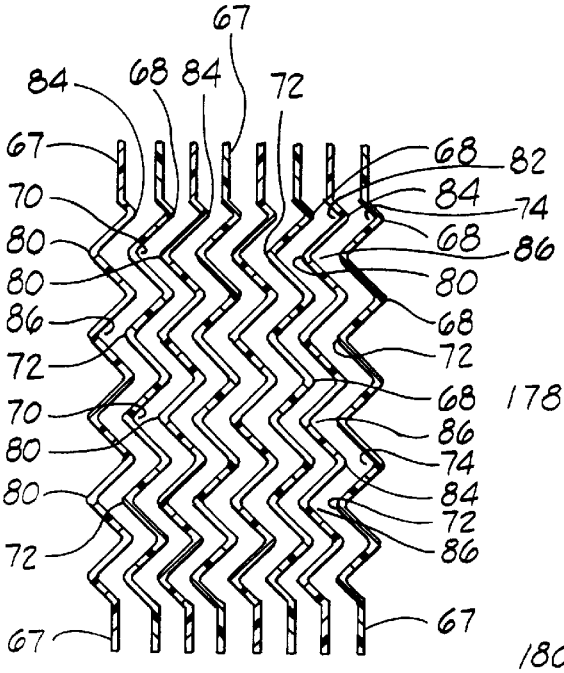
FIG. 10 is a section view taken from line 10—10 of FIG. 5, which shows a plurality of pre-collection panels positioned transversely adjacent each other in a cooling tower.

As shown in FIGS. 5 and 11–14, pre-collection panels 45 are positioned laterally and transversely adjacent one another between fill material 15 and the plurality of elongated collection troughs 40. Each pre-collection panel 45 is rotated 180° from transversely adjacent panels 45, so that a section view taken perpendicularly to the direction of the corrugations shows a plurality of partially nested corrugated panels. Partially nested simply means that the crowns of the ridges on a sheet will extend beyond the crowns of the ridges of transversely adjacent sheets and partially into the furrows thereof. For example, as shown in FIG. 10, crowns 81 of ridges 80 will extend slightly past crowns 73 of ridges 63 of adjacent precollection panel 45 into furrow 70. Likewise, crowns 75 of ridges 72 will extend slightly past crowns 85 of ridges 84 into furrows 86. Thus, the panels are positioned transversely adjacent one another in a cooling tower so that the front side 54 of each of pre-collector panel 45 is adjacent the front side 54 of transversely adjacent sheets 45, and the back side 56 of pre-collection sheets 45 is adjacent the back side 56 of transversely adjacent pre-collection sheets.

By rotating each panel 180° from the adjacent panel, the proper spacing is maintained by bosses 102 and 104. As explained previously, bosses 102 and 104 extend a distance 103 from central plane 90. Distance 103 is slightly less than distances 94 and 96, so that when panels 45 are rotated and positioned so that the bosses 102 of adjacent sheets will contact one another and bosses 104 of adjacent sheets will likewise contact one another, the sheets 45 will partially nest as described above. Alternatively, bosses may be connected to each panel so that the bosses extending from the forward side of panels 45 will engage bosses extending from the rear side of panels 45. In such a case, transversely adjacent panels 45 will not be rotated, and the forward side of panels 45 will be adjacent and partially nest with the rear side of transversely adjacent panels 45.

When the panels 45 are partially nested, water falling on the uppermost of the sloped flow surfaces, designated 150*a*, 152*a*, 154*a* and 156*a* will be directed into vertical discharge drains 159. The majority of the water will be directed by the uppermost sloped flow surfaces into vertical discharge drains 159. Any water that falls over the crown of the uppermost sloped flow surfaces will fall onto a sloped flow surface therebelow, designated with the subscript "b" and will be directed thereby into a vertical flow path. This progression will continue such that any water that falls over a crown will be directed by a sloped flow surface therebelow into a vertical flow path so that virtually no liquid will reach the corrugations defining the lowermost sloped flow surfaces, designated with the subscript "e" in FIG. 1. Such an arrangement will allow substantially all of the liquid falling through the fill material to be directed into vertical flow paths 120 and 158 which will deliver the water into elongated collection troughs 40. Each sloped flow surface may have a plurality of protuberances 160 defined thereon to aid in directing the liquid falling on the sloped flow surfaces toward the vertical flow paths. Each panel 45 preferably has four or five corrugations. The embodiment in FIG. 1 shows five corrugations and thus five sloped flow surfaces. However, the panel may be corrugated to include more or less than four or five sloped flow surfaces.

As shown in FIGS. 5 and 11, the lower end of each collection panel 45 is received in a collection trough 40 at the opposed lateral edges 60 and 62 thereof and at the center 65 thereof. Thus, collection panel 45 may include downwardly extending outer legs 162 and 164 at the first and second lateral edges 60 and 62 thereof and a downwardly extending center leg 166. Downwardly extending legs 162, 164 and 166 are received in an upper opening 170 of collections troughs 45.

Collection troughs 40 include a pair of opposed upstanding legs 172, including first and second upstanding legs 171 and 173, respectively, connected by an arcuately shaped bottom portion 174 to define an interior 176 communicated with upper opening 170. A pair of upper guide legs 178 and lower guide legs 180 extend inwardly from upstanding legs 172 near the upper opening 170 of trough 40. Downwardly extending center legs 166 may be received between the upper opposed guide legs 178 and the lower opposed guide legs 180 so that vertical flow paths 120 are directed into the upper opening 70 of collection troughs 40. Likewise, downwardly extending legs 162 and 164 of laterally adjacent panels 45 are received between pairs of guide legs 178 and 180. Because legs 162 and 164 of laterally adjacent panels are received in one collection trough, the trough helps to keep the panels properly positioned. Thus, the water flowing downward in the vertical flow paths 120 and 158 is collected in the collection troughs 40.

A flapper means 190 may extend between adjacent collection troughs 40. Flapper means 190 comprises a substantially flat panel 192 having a first or upper end 194 and a second or lower end 196. A retaining lip 198 is defined at the upper end 194 of flapper means 192. A retaining groove 200 is defined at the lower end of 196 of flapper means 190 by an angular lip 202 defined at the lower end of 196 thereof and by a retaining leg 204 extending from flat panel 192 above angular leg 202.

As shown in FIG. 5, flapper means 190 extends between adjacent collection troughs 40 and closes an air space 205 therebetween when there is no air flow upward therethrough. First leg 171 of collection troughs 40 may have an indentation 206 defined therein and may include a flapper retaining finger 208 extending upward from the lower end of indentation 206. A space 207 is defined between the flapper retaining finger 208 and the indentation 206. Collection trough 40 further includes an extension 212 extending outwardly and upwardly from bottom portion 174. Extension 212 has an upper end 214. A flange 216 extends inwardly toward second leg 173 from upper end 214 of extension 212. Flange 216 is received in groove 200 and retaining lip 198 engages flapper retaining finger 208 when there is no air flow upward between the collection troughs. As will be explained in more detail hereinbelow, when a fan causes air to move upwardly through the tower, the flapper 190 will rotate upward to the position shown by the dotted line in FIG. 5.

As set forth herein, collection system 30, including the pre-collector 35 and the collection troughs 40 of the present invention can be used with many different types of cooling tower and various types of fill material. However, the preferred embodiment disclosed herein shows each precollection sheet 45 connected to a sheet, or panel of fill media 140.

Figure 4:
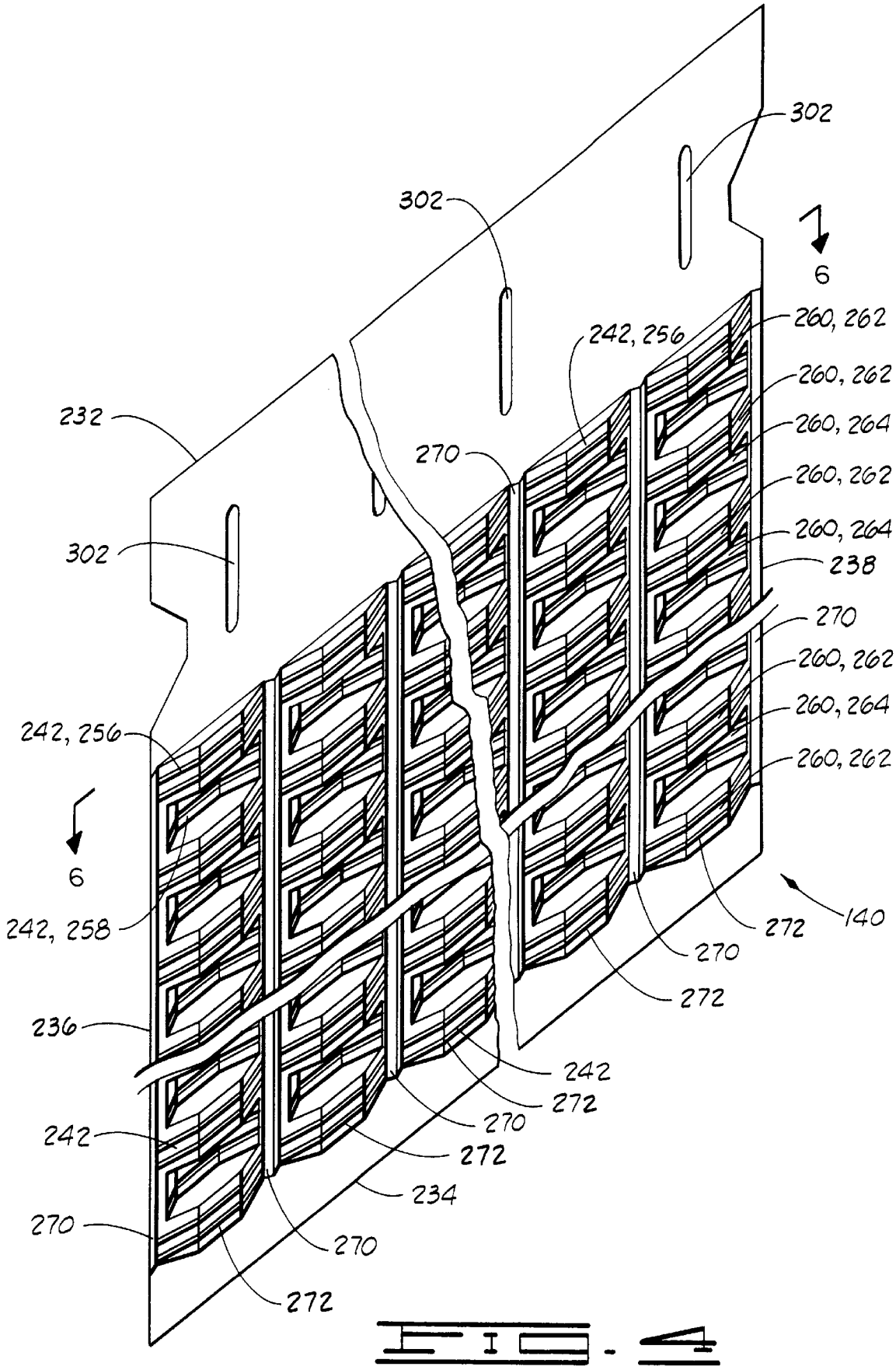
FIG. 4 is a perspective view of a sheet or panel of fill material which may be used in combination with the pre-collection panels of the present invention.
Figure 8:
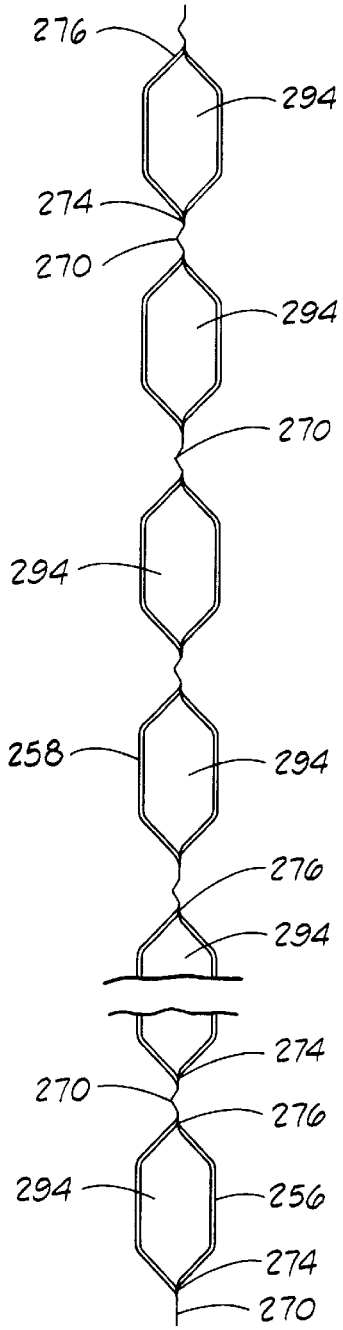
FIG. 8 is a view looking down at a plurality of sheets of fill media positioned transversely adjacent one another.
Figure 8:
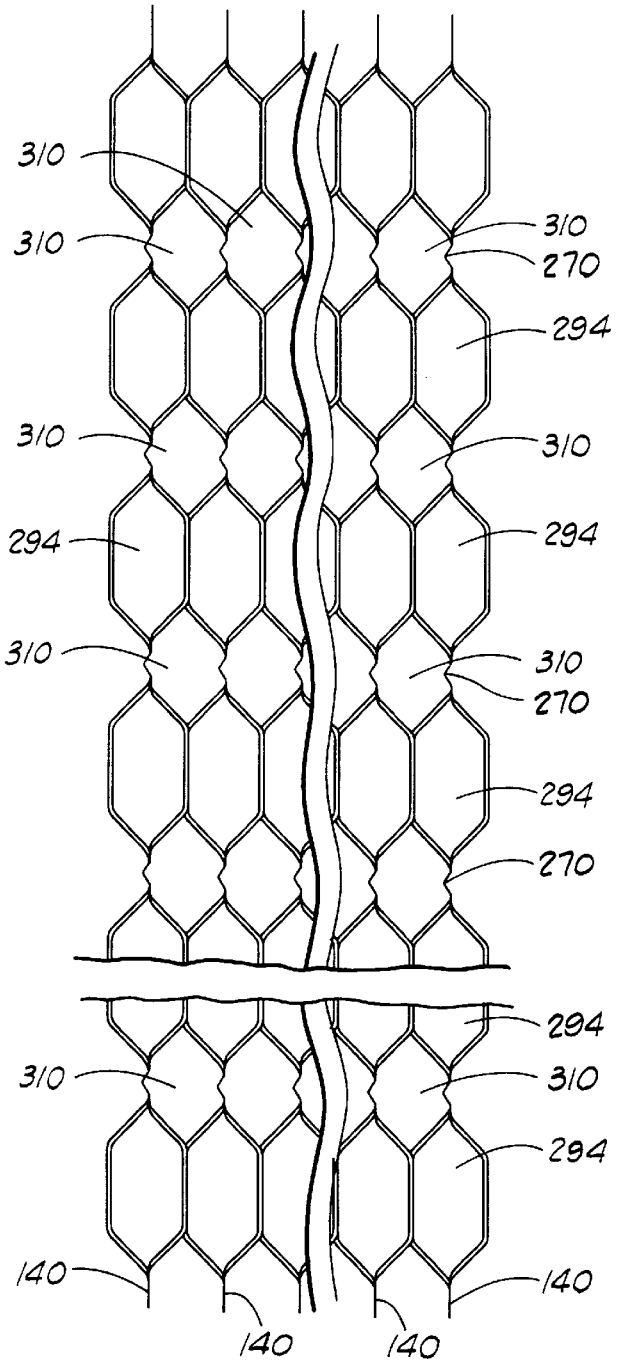

Panels 140 may be positioned transversely adjacent each other as shown in FIGS. 8 and 9 to form the fill media of the present invention. As shown in FIG. 4, each panel 140 has an upper end 232, a lower end 234, a first lateral edge 236 and a second lateral edge 238. Upper and lower ends 232 and 234 define a planar portion 240, which in the embodiments shown in FIGS. 4, 6 and 7 is a central plane 240. The edge-to-edge direction may be referred to as the lateral direction, and the end-to-end direction may be referred to as the longitudinal direction. Central plane 240, as viewed in FIG. 7, runs in a direction perpendicular to the paper so that it is indicated by a line in that figure. Sheets 140 further include a plurality of outwardly projecting tabs 242 disposed between the upper and lower ends thereof. Each tab 242 has an upper edge 244 and a lower edge 246. Each sheet 140 has a first, or front side 248 and a second or rear side 250. Sheet 120, because it is formed from a relatively thin piece of material, is shown in some cases simply as a line. However, it is understood that sheets 140 and tabs 242 do have thickness, but that the thickness has not been shown in some figures purposely to provide for clarity and understanding. The double lines shown in FIGS. 6 and 8 reflect the irregular surface of the tabs due to the ridges defined thereon.

A portion of the plurality of tabs 242 may project outwardly, or away from first side 248, and thus from central plane 240, in a first, or forward direction 252 while a portion of the tabs project outwardly, or away from second side 250 and thus from central plane 240 in a second or rearward direction 254 wherein the second direction 254 is opposite the first direction 252. In the embodiment shown, the tabs project away from the central plane in a direction normal thereto, which may be referred to as the transverse direction.

The tabs extending in the first or forward direction may be referred to as tabs 256 while tabs projecting in the second direction may be referred to as tabs 258. As described in more detail hereinbelow, each sheet may be vertically oriented in a cooling tower such that the surfaces defined between the upper and lower edges of each tab are substantially vertical when the sheets are located in a cooling tower.

The tabs may be arranged in laterally extending, or lateral rows 260 so that each sheet has a plurality of lateral rows of outwardly projecting tabs disposed between the upper and lower ends 232 and 234, respectively thereof. Lateral rows 260 may comprise a plurality of lateral rows 262 in which all of the tabs project outwardly in the first direction and a plurality of lateral rows 264 in which all of the tabs project outwardly in the second direction. The lateral rows 262 and 264 may be arranged in alternating fashion so that the tabs in one lateral row extend outwardly in a direction opposite the direction in which the tabs in the adjacent lateral rows extend.

Each sheet 140 may also include a plurality of longitudinally extending, or longitudinal ribs, or supports 270 extending between the upper and lower ends 232 and 234 which divide the sheet into a plurality of longitudinal rows, or columns, 272. As shown in FIG. 4, each tab 242 is attached to and extends between adjacent ribs so that each tab includes a first end 274 attached to a rib 270 and a second end 276 attached to an adjacent rib 270. Although the embodiment described herein shows all of the tabs in a lateral row projecting in the same direction, the tabs in a lateral row may alternate so that each tab projects in the opposite direction from the laterally adjacent tab and likewise projects in the opposite direction from the longitudinally adjacent tabs.

Each tab projects outwardly from the ribs until it reaches an outermost point which may be identified as a crown or apex 278. Crowns 278 may comprise crowns 279 on tabs 256 and crowns 281 on tabs 258. Each tab 242 preferably extends outwardly the same distance from central plane 240, so that crowns 279 and 281 are the same distance 283 therefrom. Each tab has a plurality of ridges 280 defined between its upper and lower edges so that the inner and outer surfaces of each tab are irregular.

Tabs 256 and 258 have widths 282 and 284, respectively. An air space is defined between longitudinally adjacent tabs projecting outwardly in the same direction. In other words, an air space 286 is defined between longitudinally adjacent tabs 256 and an air space 290 is defined between longitudinally adjacent tabs 258. Air space 286 has a width 288 while air space 290 has a width 292. The sheets of fill media described herein are described in a separate patent application of the Applicant entitled FILL MEDIA FOR USE IN GAS-LIQUID CONTACT VESSELS AND METHOD OF MAKING THEREFOR, Ser. No. 08/951,724, filed Oct. 16, 1997, Harold D. Curtis, Inventor, the details of which are incorporated herein by reference.

As explained more fully herein, each sheet is preferably formed from a single piece of material such as metal or plastic. The sheet can be made by serrating and stamping a metal sheet, by thermoforming plastic sheets, or by other means known in the art. Thus, width 282 of tabs 256 will be very nearly equivalent to or slightly less than the width 292 of air space 290 between tabs 258. Likewise, width 284 of tabs 258 will be very nearly equivalent to or slightly less than the width 288 of air space 286 between tabs 256. Because the widths of the tabs are slightly less than the spaces between tabs which extend in the opposite direction, the sheets can be nested together for shipping or storing purposes.

As shown in FIG. 6, the outwardly projecting tabs 256 and 258 may define a plurality of longitudinally extending, or longitudinal flow channels 294. Flow channels 294 are thus defined by longitudinal columns 272. In the embodiment shown, the openings have a geometric shape 296 which is shown as hexagonal but which may be any shape. A liquid and a gas, such as the air and water in a cooling tower, passing through a flow channel 294 can migrate laterally and transversely through air spaces 286 and 290.

Each sheet 140 may further include a suspending means 300 for suspending the sheet in a gas-liquid contact apparatus disposed at the upper end 232 thereof. Suspending means 300 may comprise a plurality of slots 302 defined in panels 140. Suspending means 300 may further include a suspending member 304 extending through the openings or slots 302. Suspending member 304 has outer ends 306 which will rest on fittings or hangers installed in cooling towers as will be described herein.

Fill material 15 of the present invention thus may comprise a plurality of sheets 140 positioned laterally and transversely adjacent to one another. The sheets are preferably positioned so that tabs 256, which project outwardly in the first direction, are projecting toward the tabs 258, which project outwardly in the second direction, of transversely adjacent sheets. Thus, the outermost point or crown 279 of tabs 256 from one sheet 140 may project outwardly until they reach or very nearly reach the crown or outermost point 281 of the outwardly projecting tabs 258 of adjacent sheets 140. The sheets may be positioned so that each tab 256 of a sheet will be located substantially at an air space 290 between tabs 258 of an adjacent sheet. Likewise, each tab 258 may be located substantially at an air space 286 between tab 256 of an adjacent sheet. Because the width 292 of space 290 between tabs 258 is slightly greater than the width 282 of tabs 256, tabs 256 may project outwardly until they are disposed between tabs 258 of adjacent sheets. Likewise, tabs 258 may be disposed in the air space 290 between tabs 256 of the adjacent sheets.

FIGS. 8 and 9 show the sheets 140 positioned such that the tabs of one sheet extend outwardly so that the crown thereof is essentially between the crowns of the tabs extending from the adjacent sheet 140. However, the crowns of the tabs on adjacent sheets may have a space defined therebetween or may cross when suspended in a cooling tower.

When the sheets are positioned adjacent one another to form fill material 15, tabs of adjacent sheets further define the plurality of longitudinal channels 294. In addition, additional longitudinally extending, or longitudinal channels 310 are formed by positioning sheets 120 in the side-by-side adjacent relationship hereinbefore described. A plurality of laterally extending, or lateral flow channels 312, which provide for lateral migration of air and water, are also defined by the adjacent sheets.

The sheets of fill media described herein are preferably formed from single sheets of material. Although numerous types of material may be used, the preferred material is plastic. The preferred method for making the sheets when the material is plastic is thermoforming. Likewise, the preferred material for the pre-collector panels 45 is plastic and the preferred method of making each pre-collector panel is thermoforming.

Thermoforming is known in the art. However, because of the numerous serrations in the fill sheet, the method of thermoforming such sheets will be briefly described with reference to FIGS. 21–23, which schematically show a tool for thermoforming a sheet of the fill panels 140.

Figure 21:
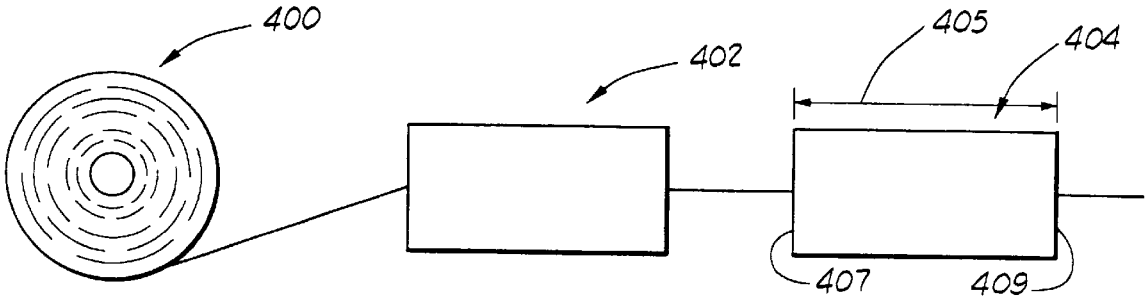
FIG. 21 is a schematic of a sheet of plastic, an oven and a tool used in a thermoforming process.
Figure 20:
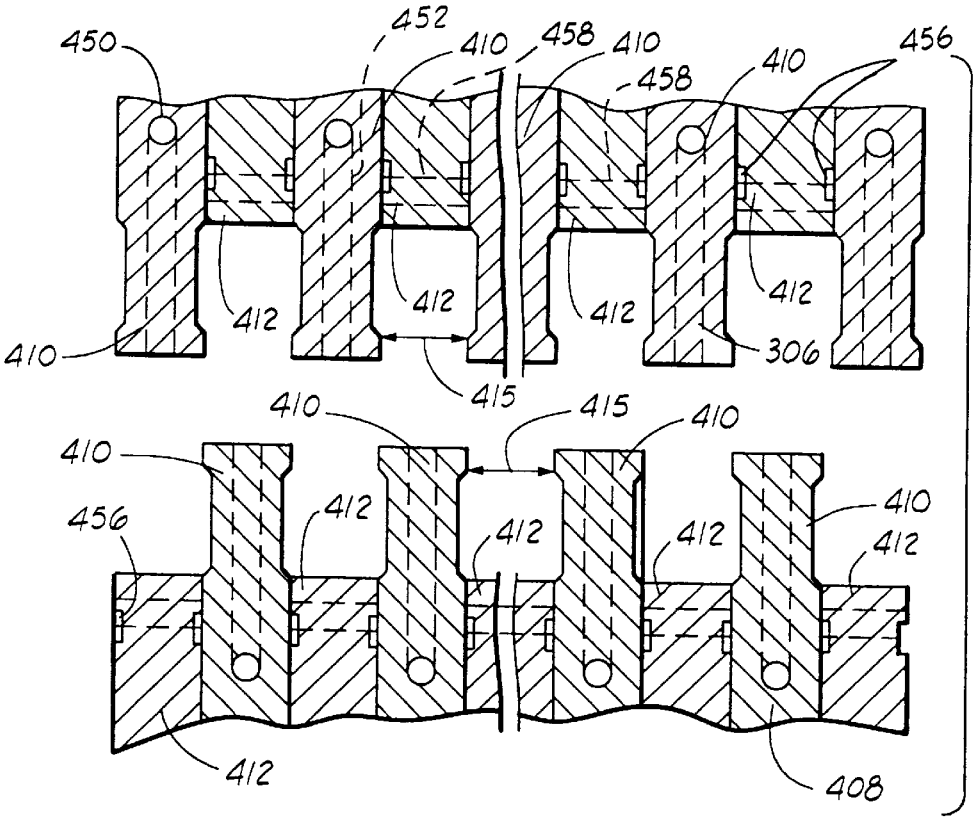

FIG. 21 schematically shows a roll of plastic 400, an oven 402, and a forming tool 404, having a width 403 and a length 405. Length 405 extends between ends 407 and 409. The plastic is heated to a desired temperature in oven 402. The temperature will vary according to the type of plastic used, and is known in the thermoforming art. After the forming operation, the plastic is trimmed and cut as desired.

Figure 22:
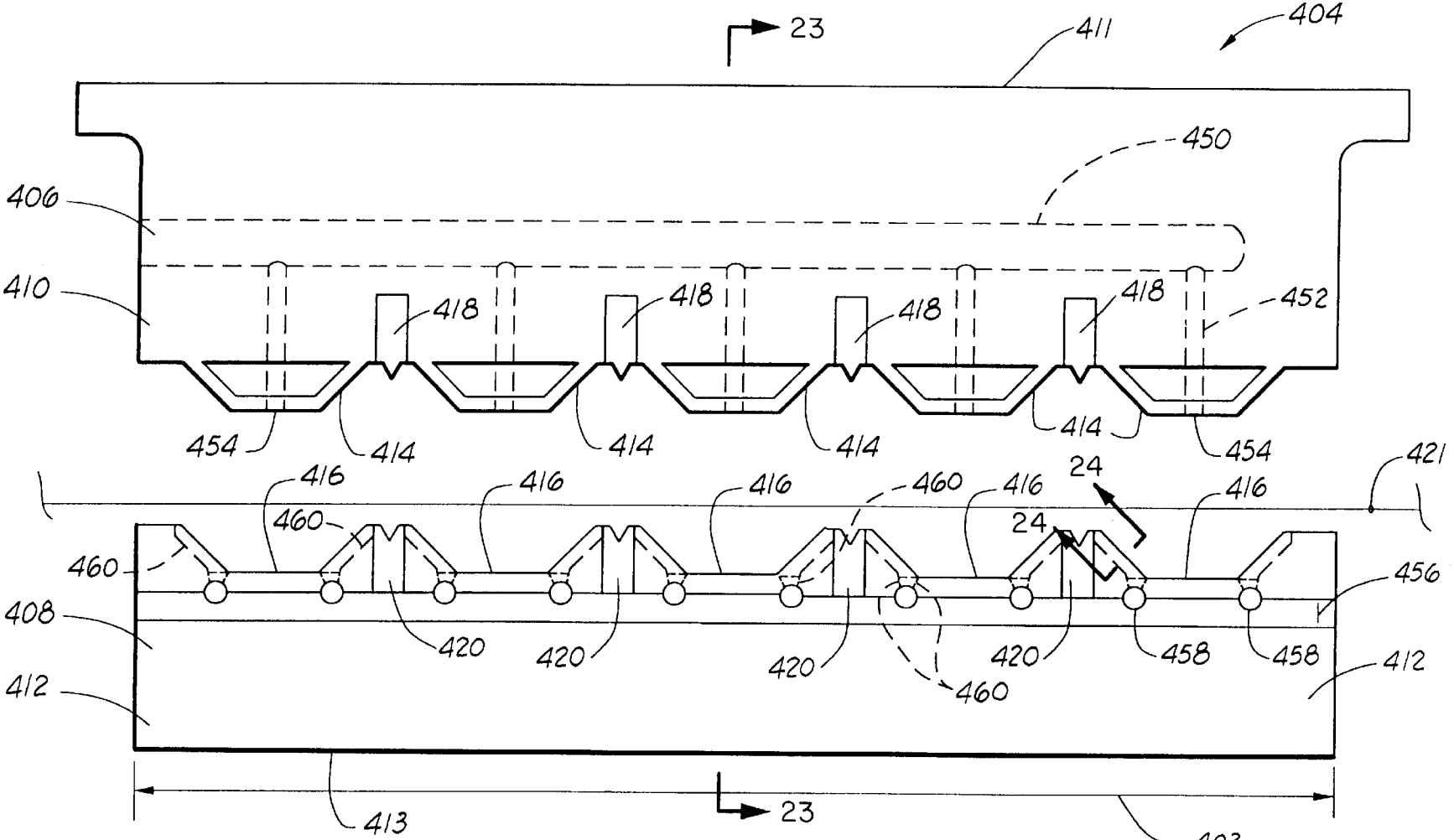
FIG. 22 is a schematic of the dies used to thermoform the panels of fill media described herein.

FIGS. 22 and 23 schematically show forming tool 404. The tool includes an upper or top die 406 having a top side 411 and a lower or bottom die 408 having a bottom side 413. Upper and lower dies 406 and 408 may each comprise a plurality of first or die punch plates 410 and a plurality of second or form plates 412.

Die punch plates 410 have a plurality of die punch projections 414 extending therefrom as shown in FIG. 22. Form plates 412 have a plurality of forming depressions 416. Depressions 416 will mate with die punch projections 414. Upper and lower dies 406 and 408 are both comprised of a plurality of die punch plates 410 and form plates 412 positioned adjacent one another in alternating fashion as shown in FIG. 23. Thus, die punch plates 410 in upper die 406 will be received between the die punch plates 410 in lower die 408 and will mate with form plates 412 in lower die 408. Likewise, die punch plates 410 in lower plate 408 will be received between die punch plates 410 in upper plate 406 and nest, or mate with form plates 412 therein.

To form the sheet of the present invention, upper and lower dies 406 and 408 are brought together so that material is deflected by die punch projections 414 until the tabs of each sheet are formed. The space 415 between adjacent plates 410 provides very little clearance for the plate 410 in the opposed die, so that as the dies are brought together, the die punch projections not only deflect the material but also serrate or cut the plastic at the interface between the die punch plates 410 in the upper and lower dies. Thus, the cutting, or serrating operation and forming operation occur substantially simultaneously. Die punch projections 414 will cut the plastic to form the upper and lower edges of each tab as the plates are brought together, and will form longitudinal columns of oppositely disposed tabs having upper and lower edges, and will form the lateral rows of similarly disposed tabs.

The plastic may be clamped at the longitudinal rib locations to form the longitudinal rows 272. Thus, upper die 406 may include a plurality of clamps 418. As is apparent from the figures, the clamps may extend through all of the die punch and form plates in upper die 406. Lower die 408 may include a plurality of clamps 420 which likewise may extend through all of the die punch and form plates therein. The tool may be configured so that at least one, and more if desired, of the clamps 418 and/or 420 are movable relative to the plates so that the clamps can be brought together to hold plastic material 421 in place prior to the final forming operation. Thus vertical clamps 420 may be configured such that they can be moved upward to the position of plastic material 421 as schematically shown in FIG. 22 so that as the plates are brought together, the plastic is held in place at the longitudinal rib locations. The clamps are positioned in such a way as to divide the sheet into a plurality of intervals which will correspond to the longitudinal columns hereinbefore described.

High pressure air can be applied from both top and bottom sides to aid in the forming of details on the sheets, such as the ridges 280. Because upper die 406 and lower die 408 each have projections and depressions to form tabs projecting outwardly in opposite directions, it may be necessary to apply air pressure (or alternatively a vacuum) from both the upper and lower die. In a typical prior art thermoforming, details are usually formed by applying high pressure air from only one side. However, air pressure, or a vacuum, may be applied from both the upper and the lower dies 406 and 408.

Thus, as schematically shown in FIGS. 22 and 23, each die punch plate 410 may include an air injection port 450. A plurality of inlet ports 452 communicate with injection port 450 and extend from the injection ports through the die punch projections 414. Each inlet port 452 has an exit opening 454 defined on the outer surface of the projections 414. A high pressure air hose (not shown) can be communicated with the air injection port 450 and thus the inlet ports 452 so that air pressure can be applied to, or a vacuum pulled on, the sheet being thermoformed.

Figure 24:
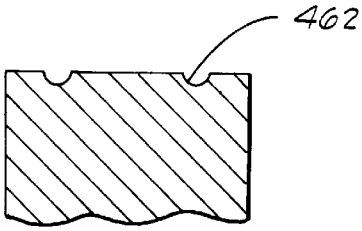
FIG. 24 shows a section view from lines 24—24 of FIG. 22.

Each form plate 412 may include a venting recess 456 defined on each side thereof. Venting recesses 456 are positioned below the forming depression. A plurality of air escape holes 458 extend through each form plate 412 and intersect the venting recesses 456. A plurality of vent ports 460 extend from the surface of the forming depression and intersect escape holes 458. When air pressure is applied through inlet ports 452, the air can pass into vent ports 460, escape holes 458 and is released into venting recesses 456. A partial vacuum can also be achieved simply by pulling air through injection port 450 and inlet ports 452. The air pressure (or vacuum) will aid in the formation of details, such as ridges 280 on the tabs. To form the ridges, or the particular shape desired, the die punch projections and forming depressions may include indentations on all, or a portion of the surface thereof so that the air pressure (or vacuum) will urge the sheet into the indentations to create the desired ridges or other detail. An example of such indentations, or depressions, is shown in FIG. 24, which shows indentations 462 defined thereon. Because the upper die 406 and lower die 408 each include a plurality of die punch plates 410 and form plates 412, the air pressure, or vacuum, can be applied from both the top and the bottom of the tool, so that the desired detail can be formed on each tab.

In a preferred embodiment, each fill material panel 140 is connected to a pre-collection panel 45. Preferably, fill material sheets 140 and pre-collection panels 45 are integrally formed as a unitary panel which may be referred to as combination fill/pre-collector panels 320. The width of each panel 320 may be as desired. In the preferred embodiment, panels 320, and thus each panel 140 and 45 has a two-foot width. Panels 140 having a two-foot width are shown as having and preferably do include ten tabs in each lateral row. Preferably, the tabs 242 extend away from planar portion 140 approximately one-half inch, although the tabs may extend more or less than one-half inch. Each two-foot panel further preferably has five or six slots 302, but may include more or less than five or six slots 302. In any event, the width of the panels, the number of tabs and the distance that tabs extend from the planar portion of the fill panels 140 may vary. Further, while the figures indicate a space between the top of corrugations 66 and the tabs 242, the panels may be formed, or connected, so that little or no space exists between the uppermost of corrugations 66 and the lowermost of tabs 242.

Figure 7A:
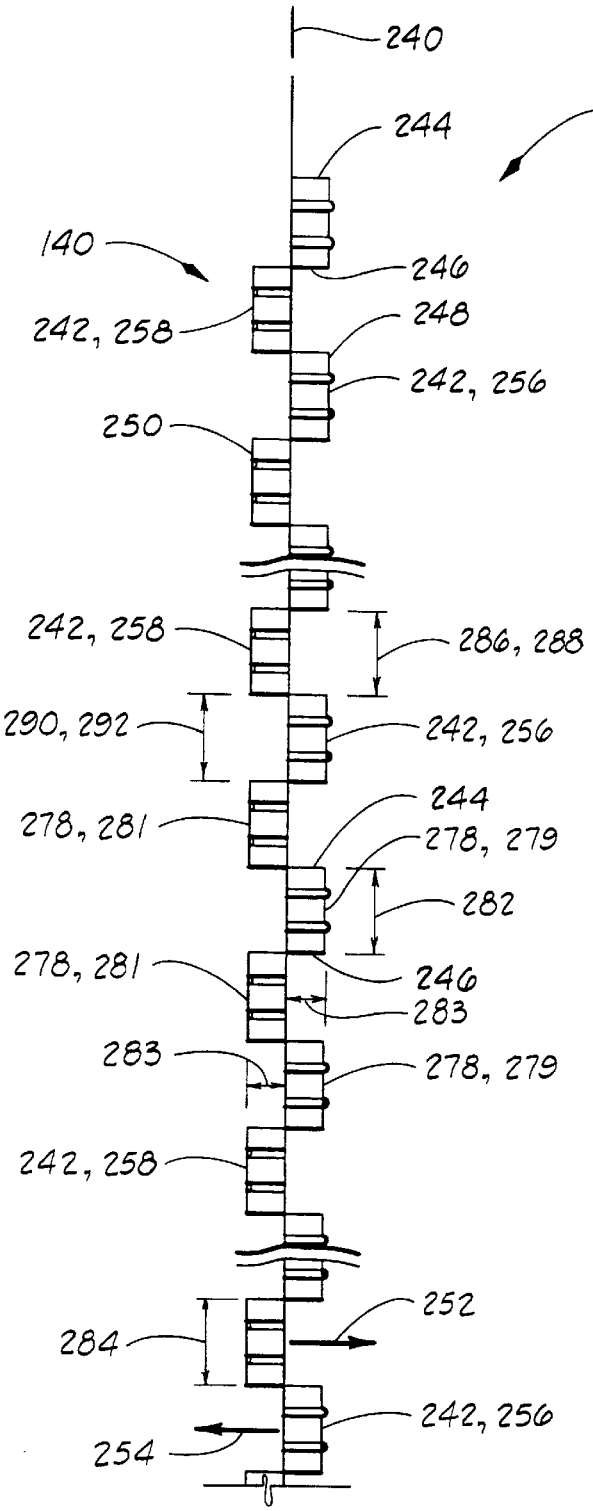
FIGS. 7A and 7B show a view of one sheet of fill media and a side view of a pre-collection panel connected thereto or integrally formed therewith.
Figure 7B:
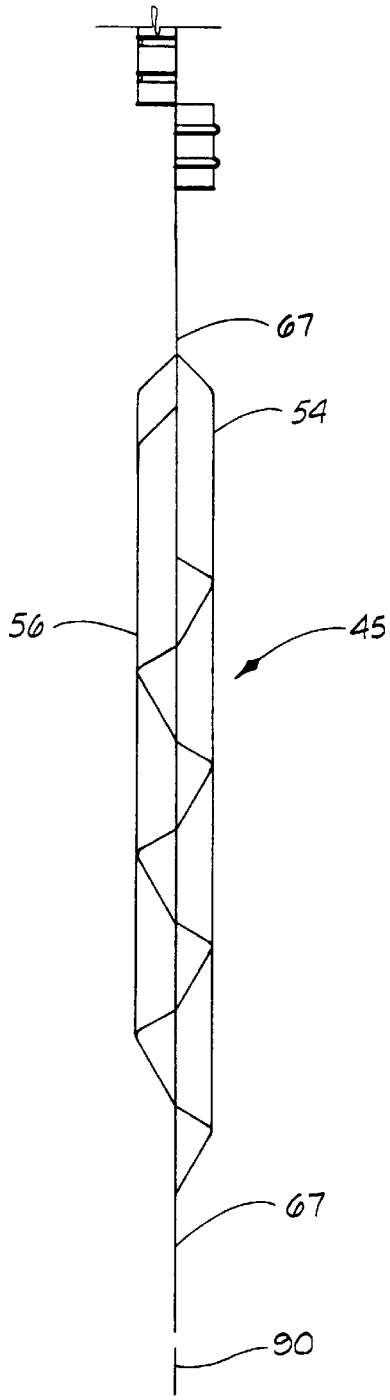

As depicted in FIGS. 7A and 7B, planar portions 90 and 240 are substantially coplanar. Bosses 100 extend away from planar portions 90 and 240 substantially the same distance as tabs 242 so that when panels 120 and 45 are suspended in a cooling tower, fill collector panels 140 will be positioned as described previously with reference to FIGS. 8 and 9 while the corrugations of pre-collector panels 45 will partially nest as described with reference to FIG. 10. As noted, the crowns of the corrugations will extend slightly beyond bosses 102. The distance between the crowns of adjacent parallel crowns may vary, and although not limited in any way, in a preferred embodiment may be between 3.5 and 4.5 inches.

As is apparent from the drawings, the combined pre-collector/fill panels, whether connected by mechanical means or integrally formed together, may include two separate embodiments so that they may be suspended in a cooling tower as described herein. In other words, one embodiment 320*a* may be formed so that the tabs 256 extending in forward direction 252 are on the same side of planar portions 90 and 240 as first side 54 of the attached pre-collection panel 45. In a separate embodiment 320*b*, tabs 258 extending in rear direction 254 may be on the same side of planar portions 90 and 240 as first side 54 of the attached pre-collection panel 45. Thus when panels 45 are rotated 180° as described herein, the fill material tabs of panels 320*a* and 320*b* will be positioned properly as shown in FIG. 9. Alternatively, as set forth previously, the bosses can be attached to provide the proper spacing between panels 45 such that rotation of transversely adjacent panels is not required, and only one embodiment 320*a* is required. In such a case, the forward sides of the panels 140 will be adjacent the rear side of transversely adjacent panels 140, and the forward side 54 of pre-collection panels 45 will be adjacent the rear side 56 of transversely adjacent pre-collection panels 45.

Referring now to FIGS. 11–14, collection system 30 is shown schematically in cooling tower 10. Liquid distribution system 20 may consist of a plurality of laterals 330 connected to a header pipe 332. Water is provided from a supply source (not shown) and flows into header pipe 332 and is directed into laterals 330. As shown in FIG. 12, laterals 330 may comprise concrete laterals 334 having water pipes 336 extending therethrough. Concrete laterals 334 are supported at one end by a notch 335 in end walls 344 and by shoulders 337 defined on header 332. Shoulders 337 and notches 335 are seen better in FIGS. 11 and 13. A plurality of fluid distributors 338 are communicated with and extend downward from water pipes 336. Fluid distributors 338 may be like those described in U.S. Pat. No. 5,152,458 to Curtis, issued Oct. 6, 1992, the details of which are incorporated herein by reference. For reference purposes, the walls shown in FIG. 12 will be referred to as side walls 340 having a width 342 therebetween. Likewise, the walls shown in FIG. 11 will be referred to as end walls 344 with a distance or width 346 therebetween. Preferably, distances 342 and 346 are substantially equivalent. Walls 340 and 344 may be supported with legs or supports 345.

FIG. 13 is a top view of the liquid distribution system and the fill and collection suspension systems. The fill material is not shown. As shown therein, header pipe 332 extends between walls 340 and is in communication with a liquid supply pipe 348 which provides liquid from a supply source (not shown).

A fill suspension system 350 includes a plurality of lateral supports 352. Lateral supports 352 are supported at the ends thereof by shoulders 337 and notches 335. Each lateral support 352 has a continuous channel 354 connected thereto with bolts or other means known in the art. As shown in FIG. 13, lateral supports 352 include five pairs of lateral supports, including pairs 352*a*, 352*b*, 352*c*, 352*d* and 352*e*. A channel 364 is attached to header pipe 332 between each pair of lateral supports, with bolts or other means known in the art. Fill hangers 356 which may comprise arrow-shaped fill hangers having legs 353 and a central web 355, are connected to continuous channels 354 and channels 364. Fill hangers 356 may be connected to continuous channels 354 and channels 364 with eye bolts 357 and fill hanger wires 358. Fill hangers 356 may have holes defined therethrough to receive hanger wires 358 so that hanger wires 358 may be inserted through the holes and tied therethrough. Likewise, wires 358 may be wrapped through eye bolt 357 and tied thereto. The wires 358 preferably are stainless steel wires. As shown in FIG. 11, a fill hanger 356 will thus be attached to each pair of lateral supports 352 and thus channels 354, and the channels 364 therebetween. Fill hanger wires 358 are attached to and extend downwardly from channel 364 in the manner described herein with reference to channels 354.

Each fill hanger 356 substantially spans the distance 346 between walls 344, and are attached to continuous channels 354 and channels 364 at a plurality of locations with eye bolts 357 and wires 358. Fill suspension system 350 further includes a plurality of channels 360 bolted or otherwise connected to concrete laterals 334. A fill hanger 356 is connected to adjacent channels 360 with eye bolts 357 and fill hanger wires 358 as described herein.

Each concrete lateral 334 will have a plurality of channels 360 connected thereto, spaced substantially identically to the spacing of wires 358 shown in FIG. 11 attached to continuous channel 354. As shown in FIG. 13, concrete lateral 334 comprises pairs of concrete laterals 334*a*, 334*b*, 334*c*, 334*d*, 334*e* and 334*f*. A channel 364 is connected to concrete header 332 between each pair of concrete laterals.

Channels 360 have a fill hanger wire 358 connected thereto and extending downward therefrom, and as noted above are attached to concrete laterals 334 between end walls 344 spaced substantially identically to the spacing of wires 358 shown in FIG. 11. A fill hanger 356 extending between walls 344 is thus connected to each pair of concrete laterals with hanger wires 358 connected to channels 360 and the channel 364 connected to header pipe 332 between each pair of concrete laterals 334. Thus, in the embodiment shown, eleven fill hangers 356 are included, one connected to each pair of concrete laterals 334 and one connected to each pair of lateral supports 352. Each fill hanger is thus connected by a plurality of hanger wires 358.

As is apparent from the drawings, specifically FIG. 12, sheets 140 may be suspended by inserting suspending members 304 through slots 302 and placing the outer end 306 to suspending members on adjacent fill hangers 356. An angle bracket 366 which spans between walls 344 is connected to each wall 340 so that for fill hangers adjacent walls 340, the outer end 306 of suspending members 304 may be placed on an angle bracket 366 and a fill hanger 356. Each suspending member 304 will thus extend through a plurality of panels 140. Each panel, because it has a plurality of slots 302 will be carried by a plurality of suspending members 304.

The length of each fill panel 140 can be as desired and in a cooling tower application will typically be five to six feet. As provided herein, the width of each panel 140, and the width of each pre-collector panel 45 is preferably two feet but is a matter of design choice. The sheets are positioned laterally and transversely adjacent each other until a sufficient number of sheets have been used to substantially fill the space defined by the distances 342 and 346. Each pre-collection panel 45 is connected to or integrally formed with a fill sheet 140 so that pre-collector panels 45 are likewise suspended in the cooling tower. As is apparent from the drawings, sheets 140 and 45 schematically depicted in FIG. 12 do not represent the actual number of sheets that will be placed between hangers. The width of such sheets, relative to the cooling tower, is not nearly as great as shown, and a much greater number of sheets will be utilized to fill the tower. The schematic was drawn as shown to provide for clarity of description. Each collection trough 40 is disposed beneath a vertical flow path 159. The collection troughs are suspended in the tower by a suspension system 370 as follows.

Suspension system 370 includes a plurality of collector hanger wires 372 connected to continuous channels 354 with eye bolts 357. Suspension system 370 further includes wire hanger inserts 374 and collector spacers 376 as shown in FIGS. 18A–18C and 19A–19C, respectively. Wire hanger insert 374 has substantially flat outer surfaces 378 and 380 defining a thickness 379. Wire hanger insert 374 also has an upper end 381 and a lower end 383. A hole 382 extends through wire hanger insert 374 from the upper end 381 to the lower end 383 thereof at substantially the center of thickness 379 and between outer edges 385 thereof. A second hole 384 extends upward from the lower end 383 and extends only partway through wire hanger insert 374. Holes 382 and 384 are connected by a groove 387 defined in lower end 383 of wire hanger insert 374 so that a substantially J-shaped opening 386 is defined in wire hanger insert 383. Collector hanger wire 372 has a substantially J-shaped lower end 373 so that it will be received in holes 382 and 384 and will suspend wire hanger insert 383 from continuous channel 354.

Figure 20:
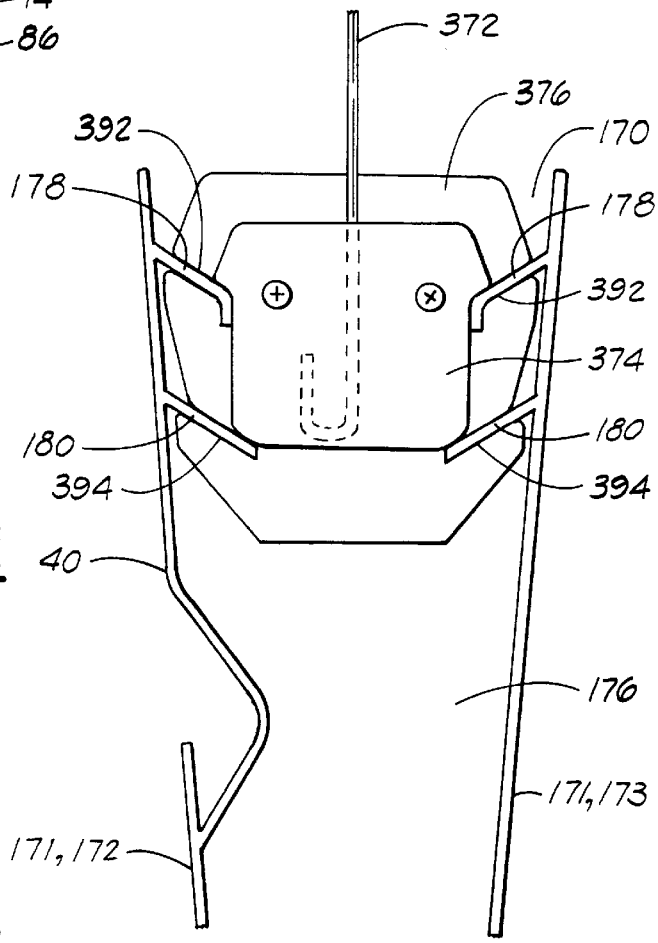
FIG. 20 shows a wire hanger insert and collection spacer in a collection trough.
Figure 26:
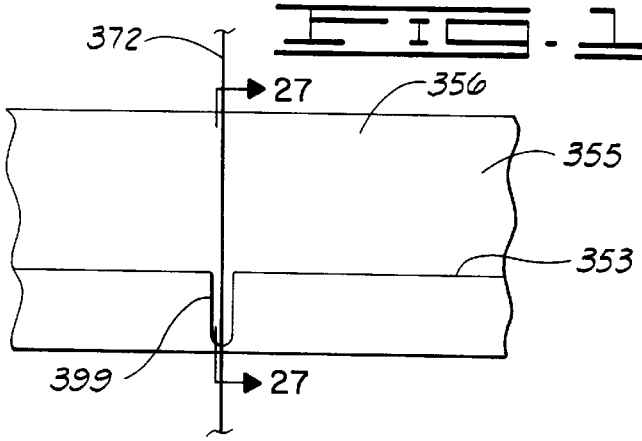
FIG. 26 shows a fill hanger with a slot for a collector wire defined therein.
Figure 27:
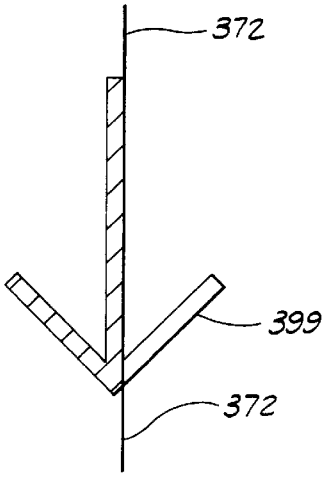
FIG. 27 is a view from line 27—27 of FIG. 26.
Figure 14:
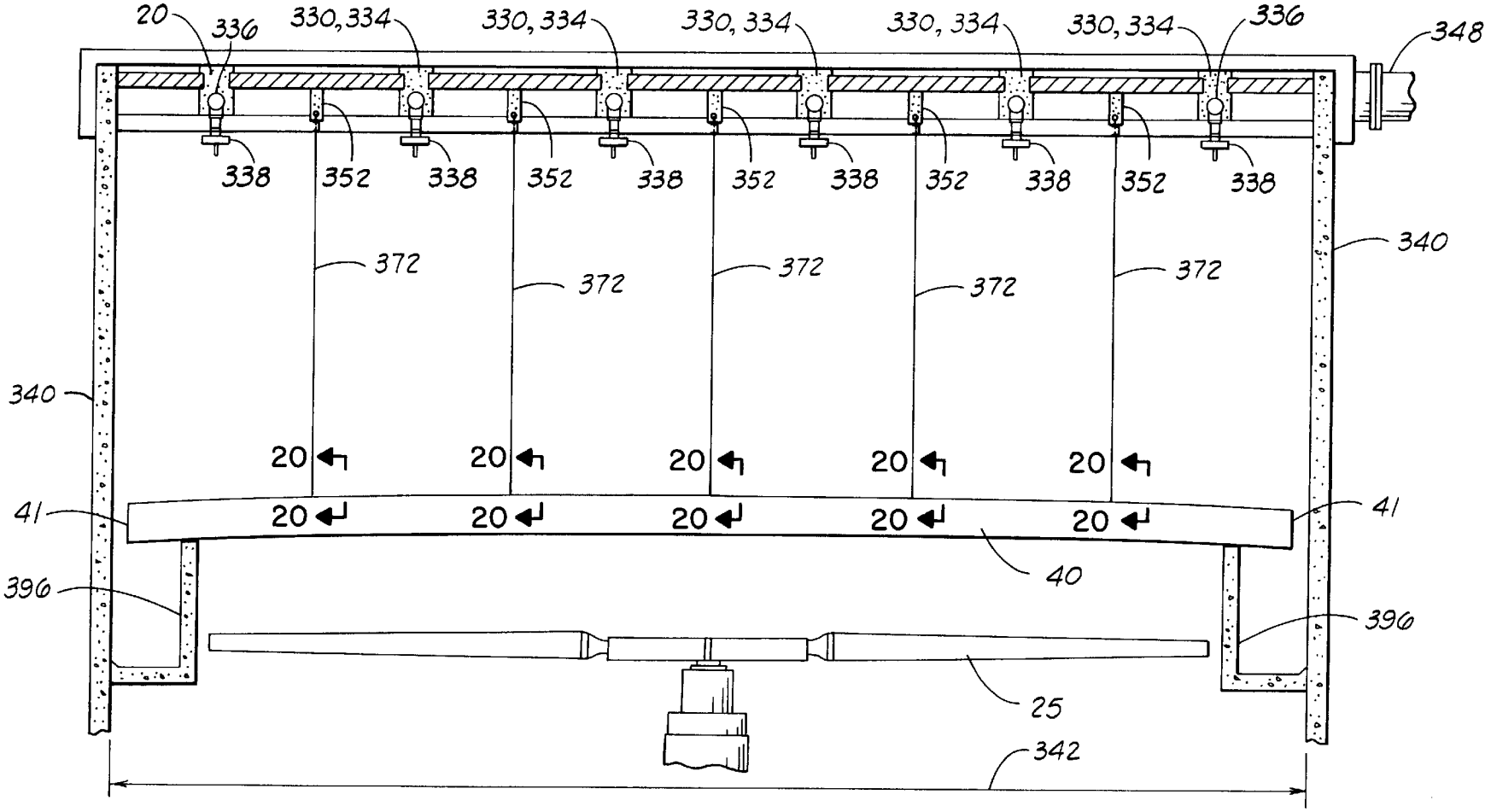
FIG. 14 schematically shows a portion of the collection trough suspension system.
Figure 15A:
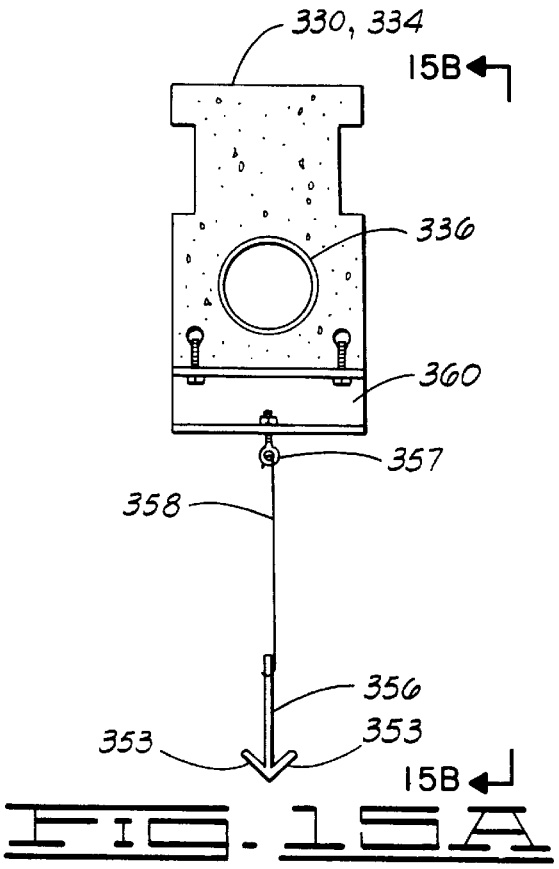
FIGS. 15A, 15B and 16 show the attachment of fill hangers to the fill hanger support structure.
Figure 15B:
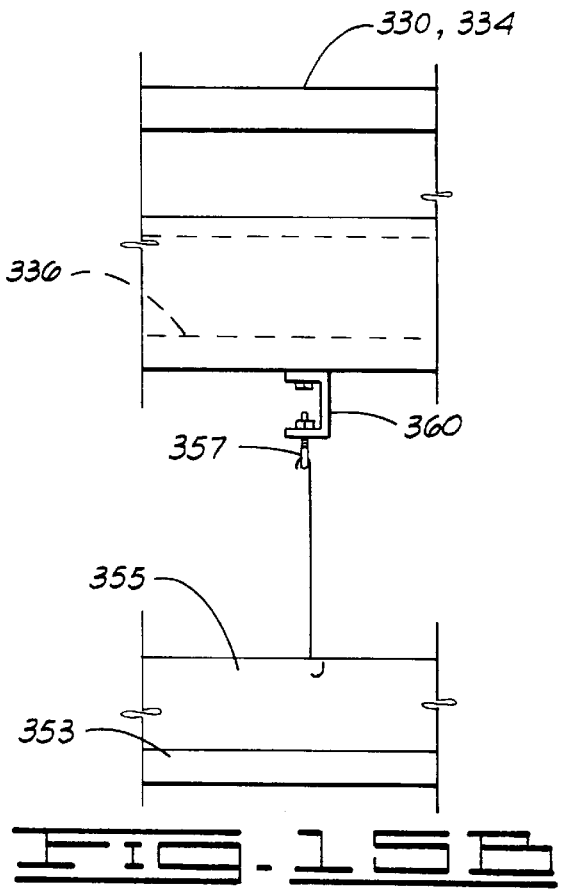
Figure 16:
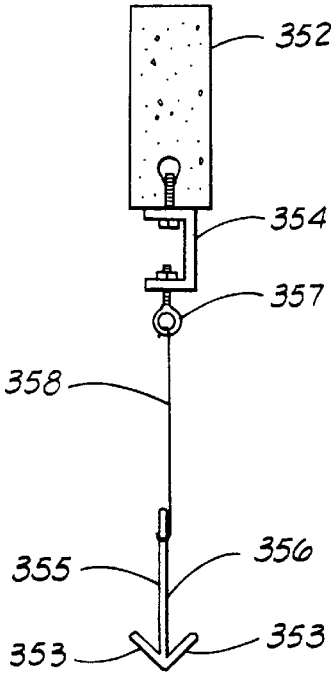
Figure 17:
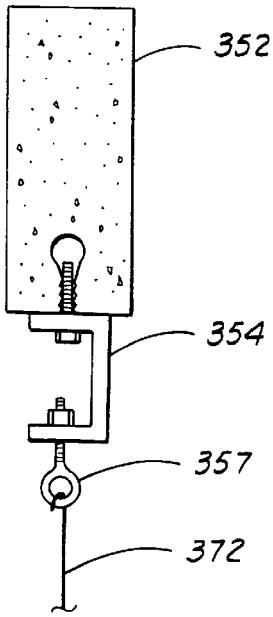
FIG. 17 shows the attachment of the collection trough hangers to the collection trough support structure.
Figure 18A:
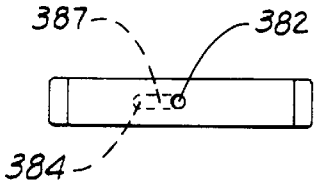
Figure 19A:
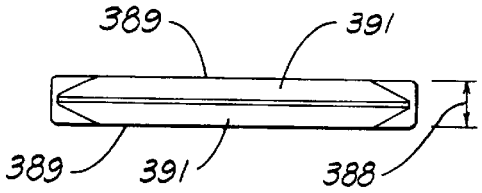
FIGS. 19A, 19B and 19C show the top, side and front views, respectively, of a collection trough spacer of the present invention.
Figure 18B:
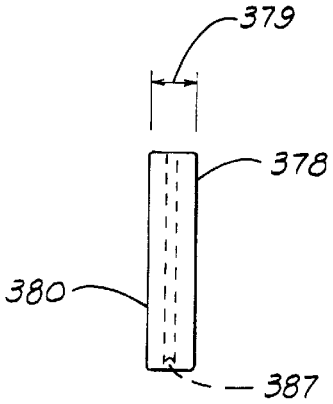
Figure 19B:
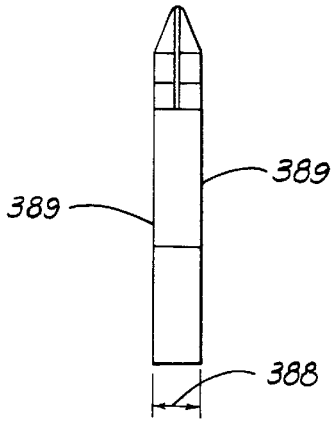
Figure 18C:
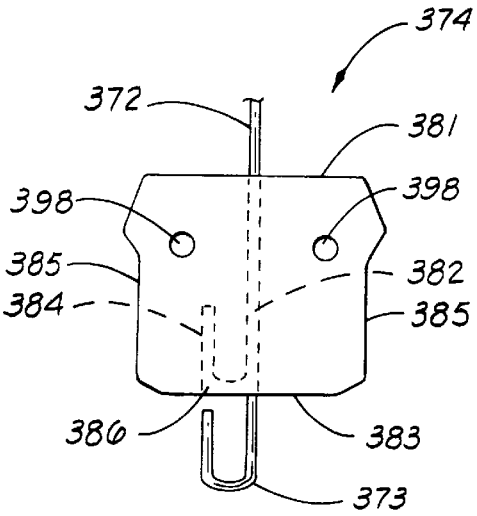
Figure 19C:
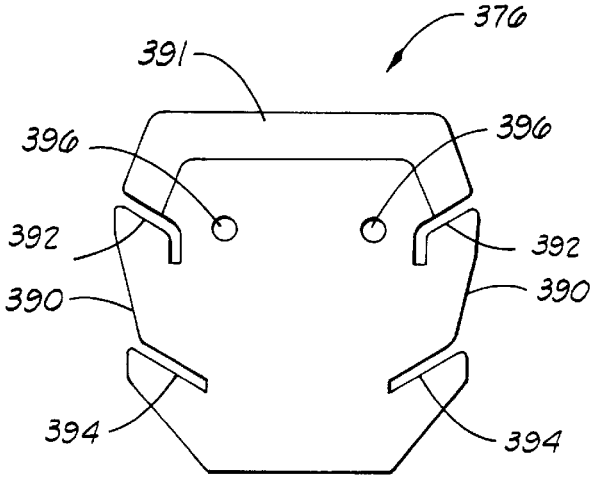

Collector spacer 376 has a thickness 388 defined by outer surfaces 389. Collector spacer 376 likewise has opposed outer edges 390. A pair of upper opposed grooves 392 and lower opposed grooves 394 extend inward from outer edge 390 of collector spacer 376. Upper grooves 392 are shaped to receive upper guide legs 178 of collection troughs 140 and lower grooves 394 are shaped to receive lower guide legs 180 of collection troughs 140. Collector spacer 376 has a pair of holes 396 defined therethrough to mate with holes 398 defined in wire hanger insert 374. In order to suspend the collection troughs, wire hanger insert 374 is attached to collector spacer 376 with screws or other fasteners through mating holes 396 and 398. As shown in FIG. 20, a plurality of assemblies of the wire hanger insert 374 and collector spacer 376 are placed in collection troughs 40 so that the legs 178 and 180 are received in grooves 392 and 394. Hanger wires 372 are inserted into openings 386 so that the upwardly extending legs of J-shaped lower end 373 of wires 372 are received in holes 384 thus suspending the collection trough in the cooling tower when wire 372 is connected to continuous channel 354 thereabove. As shown in FIG. 14, each collection trough may be suspended with five wires 372 connected to wire hanger inserts 374. At each location where a wire 372 is connected, a slot 399, as shown in FIGS. 26 and 27, may be defined in a leg 353 of hangers 356 so that the wires 372 will hang substantially vertically and will be adjacent webs 355 of fill hanger inserts 356.

Preferably, the length of wires 372 is slightly less at the center of the collection troughs so that the collection troughs will have a slight downward incline from the center toward the primary collection channels 396 defined below the ends of the collection troughs 40 at walls 340. In addition, a secondary collection channel 398 is attached to each end wall 344 below the lower end of the outermost pre-collection panels 45 to collect liquid falling down the free lateral edge thereof.

In operation, liquid will fall on the sheets 120 of the fill material 15. The upper edges of the tabs on the fill material will act like diffusers and will cause the water to splash and spray. Water will travel down both the inner and outer surfaces of the tabs, will coalesce on the lower edge of the tab or between neighboring crowns, and will drip or flow downward. The falling liquid will then contact the upper edge of the tabs therebelow. A portion of that water will splash and be forced by the air stream onto the inner and outer surfaces of other tabs while a portion of the water will migrate downward on the surface. As the water falls downward through the fill media, cooling air blowing upward therethrough from the fan 25 will cool the water.

When water reaches the lower end of the sheets of fill media, it will, as described previously, be directed by pre-collection panels 45 into collection troughs 40 and, at the free lateral edges thereof, into secondary collection channels 398.

The liquid will fall on the uppermost corrugations 150*a*, 152*a*, 154*a* and 156*a* on the front and back sides of each pre-collection sheet 45 and thus will be directed by the uppermost sloped flow surfaces to vertical discharge drains 159. The liquid will then travel down vertical discharge drains 159 into collection troughs 40 and, at the two outer free edges of the pre-collector into secondary collection channels 398. Liquid not directed by the uppermost sloped flow surface will drip over the crown of the uppermost corrugation onto a sloped flow surface therebelow of the same or an adjacent pre-collection panel 45. The amount of liquid that reaches the lowermost corrugation on each pre-collection panel will be minimal. In this manner, substantially all of the liquid falling through the fill material will be directed by the pre-collection panels into collection troughs 40. Because each collection trough 40 will have water flowing therein, the difficulties associated with icing is minimized since the flowing water will prevent freezing in the collection troughs. Likewise, because of the amount of water flowing downward at the vertical discharge drain locations, the likelihood of ice preventing such flow will be minimized, if not completely eliminated because the flow downward will insure an open pathway. In cold weather conditions, it is possible that some icing may occur between the crowns of the lowermost corrugations. However, if this occurs, water will still be directed to the vertical flow path by the corrugations thereabove so that the water will still be directed into and collected by collection troughs 40. Water collected in collection trough 40 will flow into primary collection channels 396 defined at walls 340 below the ends 41 of collection troughs 40. Water received in primary collection troughs 396 may be delivered to a reservoir or other basin (not shown) and recirculated.

Another advantage of the collection system of the present invention is that it creates less pressure drop through the cooling tower than prior art collection systems. As shown in FIG. 11, each collection trough 40 has an air space 205 defined therebetween. When the fan therebelow is not operating, each air space 205 will be closed by a flapper means 190. This will prevent any mist or overspray from falling downward to the fan when it is inoperative so as to eliminate the possibility of an inoperative fan icing up during cold wintertime conditions.

When fan 25 is operating to blow cooling air upward through the cooling tower, the flapper means opens and the pressure drop through the collection system is far less than that associated with other collection systems. This is because the collection troughs 40 of the present system have substantially vertical walls with air spaces 205 therebetween. In an embodiment where pre-collector panels 45 have approximate two-foot widths, there is thus a width of approximately one foot between centers of collection troughs, so that there will be an uninterrupted air space of several inches between collection troughs. In the majority of collection systems which use sloped overlapping plates that span the distance between the walls of the cooling tower, the air directed upward by the fan has little or no uninterrupted air space in which to pass prior to reaching the fill material. Because the air in such towers is interrupted by the sloped overlapping plates, a pressure drop is created. With the present invention, a substantial amount of uninterrupted air space is provided so that, in comparison to prior art collection systems, the collection system of the present invention creates very little pressure drop prior to the time the air reaches the pre-collector panels and the fill material thereabove. Thus, the efficiency of a cooling tower can be increased by utilizing the collection system of the present invention. Very simply, the collection system of the present invention creates wider air spaces for air to flow upward than was possible with previous collection systems.

Although the preferred embodiment disclosed herein describes pre-collector panels as being connected to or integrally formed with a sheet of fill material and suspended in a cooling tower, the pre-collector may be used with any type of fill material such as commercially available corrugated plastic fill material. In such a case, the pre-collector panels can be mechanically attached by attaching bosses of adjacent sheets to one another, or by other means known in the art, to create a block of pre-collector panels 45. Pre-collector panels 45 must be transversely spaced as described herein so as to properly distribute the liquid falling thereon. The collection troughs likewise may be mechanically attached to one another and mechanically attached to the walls of a cooling tower to hold them in an upright position and may rest on the primary collection channels of the cooling tower. The blocks or bricks pre-collection panels 45 will be positioned so that the lower ends are received in the collection troughs as described herein and the fill material can be placed above, and if desired directly on top of the pre-collection panels.

It is seen that the apparatus of the present invention readily achieves the ends and advantages mentioned as well as those inherent therein. While certain preferred embodiments of the invention have been illustrated and described for the purposes of the present disclosure, numerous changes may be made by those skilled in the art which changes are encompassed within the scope and spirit of the present invention as defined by the appended claims.

What is claimed is:

1. A cooling tower apparatus comprising:

a body of fill material;

a liquid distribution system located above said body of said fill material so that said liquid gravitates downward through said body of fill material;

a fan for causing cooling air to move upward through said body of fill material to contact and cool said liquid; and a collection system for collecting said liquid falling from said body of fill material, said collection system comprising:

a plurality of elongated collection troughs for receiving said liquid; and a pre-collector disposed between said fill material and said collection troughs for directing said liquid into said collection troughs, said pre-collector comprising a plurality of corrugated sheets, said sheets defining a plurality of spaced, substantially vertical liquid flow paths, said corrugations being disposed between adjacent ones of said flow paths, wherein the corrugations direct said liquid into said vertical flow paths, said collection troughs being located to collect said liquid from said flow paths.

2. The cooling tower of claim 1, said corrugations defining a plurality of sloped and overlapping flow surfaces, wherein said sloped and overlapping flow surfaces direct said liquid to said plurality of spaced vertical flow paths.

3. The cooling tower of claim 2, wherein vertical flow paths are defined at the outer edges of said sheets.

4. The cooling tower of claim 2, wherein each of said collection troughs comprise a hollow trough having an interior and an upper opening communicated with said interior, said collection troughs located to receive liquid from said vertical flow paths.

5. The cooling tower of claim 4 further comprising a plurality of flapper means disposed between adjacent ones of said collection troughs for closing an air passage defined between said adjacent plates when said fan is inoperative, and for automatically opening said air passage when said fan is operative.

6. The cooling tower of claim 1, said sheets having a forward side and a rear side, each side having said sloped and overlapping flow surfaces defined thereon.

7. The cooling tower of claim 6, wherein said sheets are positioned adjacent one another so that the forward side of said sheets are adjacent the forward sides of adjacent sheets, and so that the rear side of said sheets is adjacent the rear side of adjacent sheets.

8. The cooling tower of claim 1, said corrugations generally being inverted, V-shaped, corrugated portions defined between adjacent ones of said spaced vertical flow paths so that said sloped and overlapping flow surfaces between adjacent vertical flow paths direct said liquid into both of said adjacent flow paths.

9. The cooling tower of claim 8, each said sheet comprising adjacent V-shaped corrugated portions.

10. The cooling tower of claim 1, wherein said fan is located below said collection system, said collection system preventing said liquid from reaching said fan.

11. A cooling tower comprising:

a body of fill material;

a liquid distribution system located above said body of fill material, wherein said liquid gravitates downward through said fill material;

a fan located below said body of said fill material for blowing air upward through said body of fill material;

a plurality of spaced, elongated collection troughs positioned above said fan for collecting said liquid; and a plurality of spaced-apart pre-collector sheets disposed between said body of fill material and said collection troughs, said sheets comprising corrugated sheets, the corrugations in said corrugated sheets defining a plurality of sloped, overlapping flow surfaces wherein substantially all of said liquid falls onto said sloped and overlapping flow surfaces and is directed into said collection troughs thereby, said sheets being nestable wherein the ridges of said corrugations on a forward side of said sheet will nest in the furrows on the rear side of said sheets for shipping.

12. The cooling tower of claim 11, said sheets having opposed outer edges and forward and rear sides, the edge-to-edge direction defining a lateral direction and the forward-to-rear direction defining a transverse direction, said plurality of sheets being positioned adjacent each other laterally and transversely to substantially fill an area between said fill material and said collection troughs.

13. The cooling tower of claim 12, wherein said transversely adjacent sheets define a space therebetween.

14. The cooling tower of claim 12 wherein laterally adjacent sheets define a substantially vertical flow pathway therebetween.

15. The cooling tower of claim 12, said sheets comprising bosses extending a forward direction and a rearward direction a sufficient distance to maintain said space between said sheets wherein said bosses will contact bosses of transversely adjacent sheets to maintain said space therebetween.

16. The cooling tower of claim 11, said corrugations defining said flow surfaces on a forward side and a rear side of said sheet.

17. The cooling tower of claim 11, said flow surfaces having a plurality of protrusions defined thereon to direct said liquid falling on said surfaces toward an edge of said sheets.

18. The cooling tower of claim 11, wherein said sloped and overlapping surfaces direct said liquid into a plurality of vertical flow paths, and wherein said collection troughs are positioned below said vertical flow paths to collect said liquid therefrom.

19. A cooling tower apparatus comprising:

a body of fill material;

a liquid distribution system located above said body of said fill material so that said liquid gravitates downward through said body of fill material;

a fan for causing cooling air to move upward through said body of fill material to contact and cool said liquid; and a collection system for collecting said liquid falling from said body of fill material, said collection system comprising:

a plurality of elongated collection troughs for receiving said liquid; and a pre-collector disposed between said fill material and said collection troughs for directing said liquid into said collection troughs, said pre-collector comprising a plurality of corrugated sheets, wherein the corrugations in said corrugated sheets direct said liquid into said collection troughs, said corrugated sheets having opposed outer edges, said collection troughs being positioned below the outer edges of said sheets, wherein said corrugations direct said liquid to said outer edges of said sheets and wherein said liquid gravitates downward at said outer edge into said collection trough.

20. The cooling tower of claim 19, the edge-to-edge direction comprising a lateral direction, said corrugated sheets being positioned laterally adjacent each other so that said outer edges define substantially vertical flow paths, wherein said corrugations direct said liquid to said vertical flow paths, said collection troughs being positioned below said flow paths to collect said liquid therefrom.

21. The cooling tower of claim 20, said corrugated sheets having a forward side and a rear side, the forward-to-rear direction comprising a transverse direction wherein said corrugated sheets are positioned transversely adjacent each other so that the front sides of said sheets are adjacent the front sides of transversely adjacent sheets and the rear sides of said sheets are adjacent the rear sides of transversely adjacent sheets.

22. The cooling tower of claim 21, said transversely adjacent sheets defining a space therebetween.

23. A cooling tower comprising:

a body of fill material;

a liquid distribution system located above said body of fill material, wherein said liquid gravitates downward through said fill material;

a fan located below said body of said fill material for blowing air upward through said body of fill material;

a plurality of spaced, elongated collection troughs positioned above said fan for collecting said liquid; and a plurality of pre-collector sheets disposed between said body of fill material and said collection troughs, each of said sheets defining a plurality of sloped, overlapping flow surfaces wherein substantially all of said liquid falls onto said sloped and overlapping flow surfaces and is directed into said collection troughs thereby, wherein an upper end of each said pre-collector sheet is connected to a lower end of said fill material.

24. The cooling tower of claim 23, wherein said fill material comprises a plurality of sheets disposed in said cooling tower between said collection system and said liquid distribution system, and wherein each pre-collector sheet is connected to a sheet of fill material.

25. The cooling tower of claim 23 wherein each said pre-collector sheet is integrally formed with a sheet of fill material.

26. The cooling tower of claim 25, wherein each said sheet of fill material and pre-collector sheet connected thereto is suspended in said cooling tower.

* * * * *